US011335270B2

(12) United States Patent
Baek

(10) Patent No.: US 11,335,270 B2
(45) Date of Patent: May 17, 2022

(54) DISPLAY DEVICE AND COMPENSATION METHOD

(71) Applicant: LG Display Co., Ltd., Seoul (KR)

(72) Inventor: Lokdam Baek, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 17/122,756

(22) Filed: Dec. 15, 2020

(65) Prior Publication Data

US 2021/0201821 A1 Jul. 1, 2021

(30) Foreign Application Priority Data

Dec. 30, 2019 (KR) ..... 10-2019-0178289

(51) Int. Cl.
*G09G 3/3275* (2016.01)

(52) U.S. Cl.
CPC ... *G09G 3/3275* (2013.01); *G09G 2310/0286* (2013.01); *G09G 2310/063* (2013.01); *G09G 2320/043* (2013.01)

(58) Field of Classification Search
CPC ..... G09G 3/3275; G09G 2310/063; G09G 2310/0286; G09G 2320/043; G09G 3/3266; G09G 3/3233; G09G 2320/045; G09G 2320/0295
See application file for complete search history.

(56) References Cited

U.S. PATENT DOCUMENTS

2011/0227505 A1 9/2011 Park et al.
2014/0176516 A1* 6/2014 Kim ..... G09G 3/3233 345/204
2015/0187273 A1* 7/2015 Chang ..... G09G 3/3233 345/690
2017/0061865 A1* 3/2017 Park ..... G09G 3/325
2017/0169763 A1* 6/2017 Bi ..... G09G 5/003
2017/0186373 A1 6/2017 Nishikawa et al.
2018/0151121 A1 5/2018 Lim et al.
2018/0174507 A1 6/2018 Ohara
(Continued)

FOREIGN PATENT DOCUMENTS

CN 108806597 A 11/2018
EP 3 327 711 A1 5/2018
(Continued)

OTHER PUBLICATIONS

Partial European Search Report dated Oct. 10, 2021 for Application No. 20212691.8.

*Primary Examiner* — Ibrahim A Khan
(74) *Attorney, Agent, or Firm* — Birch, Stewart, Kolasch & Birch, LLP

(57) ABSTRACT

A display device and a compensation method of the display device are discussed. A sensing method for compensation, which is performed after a display device is powered off, includes displaying 1 black frame, charging a node M of a shift register A connected to a $j^{th}$ gate line of a display panel, charging a node M of a shift register B connected to a $K^{th}$ gate line of the display panel, and sensing subpixels connected to the $j^{th}$ gate line and then sensing subpixels connected to the $K^{th}$ gate line.

15 Claims, 27 Drawing Sheets

(56) References Cited

U.S. PATENT DOCUMENTS

| | | | | |
|---|---|---|---|---|
| 2018/0337682 | A1* | 11/2018 | Takasugi | G09G 3/3241 |
| 2019/0103049 | A1* | 4/2019 | Noh | G09G 3/20 |
| 2019/0180691 | A1 | 6/2019 | Takasugi | |

FOREIGN PATENT DOCUMENTS

| | | | |
|---|---|---|---|
| KR | 10-2018-0125761 | A | 11/2018 |
| KR | 10-2019-0077689 | A | 7/2019 |
| WO | WO 2019/157842 | A1 | 8/2019 |

* cited by examiner

DISPLAY DEVICE AND COMPENSATION METHOD

CROSS REFERENCE TO RELATED APPLICATION

The present application claims priority to Korean Patent Application No. 10-2019-0178289, filed on Dec. 30, 2019 in the Republic of Korea, the entire contents of which are hereby expressly incorporated by reference into the present application.

BACKGROUND OF THE INVENTION

Field

The present invention relates to a display device and a compensation method and more particularly to a method for sensing a threshold voltage of a driving thin film transistor (TFT) of subpixels after a display device is powered off and a display device performing the method.

Description of the Related Art

With the development of information society, various types of display devices are being developed. Recently, a variety of display devices such as a liquid crystal display (LCD), a plasma display panel (PDP), and an organic light emitting display (OLED) are being used.

An organic light emitting device constituting the OLED emits light by itself, and thus, does not require a separate light source. Therefore, the thickness and weight of the display device can be reduced. Also, the OLED shows high quality characteristics, for example, low power consumption, high luminance, and high response speed, etc.

Such an OLED can have degradation in a display quality due to the characteristics of transistors included within the OLED or due to the degradation of the organic light emitting device.

SUMMARY OF THE INVENTION

In order to solve or address the above-described problems and other limitations, the purpose of the present invention is to provide a method for sensing the characteristics of a driving transistor of a subpixel and to provide a display device which is driven by the method.

One embodiment of the present invention provides a sensing method for compensation which is performed after a display device is powered off. The sensing method includes displaying 1 black frame; charging a node M of a shift register A (first shift register) connected to a $j^{th}$ gate line of a display panel; charging a node M of a shift register B (second shift register) connected to a $K^{th}$ gate line of the display panel; and sensing subpixels connected to the $j^{th}$ gate line and then sensing subpixels connected to the $K^{th}$ gate line.

The charging a node M of a shift register A and the charging a node M of a shift register B can be performed during the displaying 1 black frame.

The charging a node M of a shift register A and the charging a node M of a shift register B can be sequentially performed.

The charging a node M of a shift register A can include receiving an LSP A signal through a line to which the shift register A is connected in a local way.

The charging a node M of a shift register B can include receiving an LSP B signal through a line to which the shift register B is connected in a local way.

The method can further include, before sensing subpixels connected to the $j^{th}$ gate line, receiving an RST1 A signal through a line to which the shift register A is connected in a local way; and charging a node Q of the shift register A by that a carry charged in the node M of the shift register A moves to the node Q.

The method can further include, after sensing subpixels connected to the $j^{th}$ gate line, receiving an RST2 signal through a line to which the shift register A is connected in a global way; and discharging the node Q of the shift register A.

The method can further include, before sensing the subpixels connected to the $K^{th}$ gate line, receiving an RST1 B signal through a line to which the shift register B is connected in a local way; and charging a node Q of the shift register B by that a carry charged in the node M of the shift register B moves to the node Q.

The method can further include, after sensing the subpixels connected to the $K^{th}$ gate line, receiving the RST2 signal through a line to which the shift register B is connected in a global way; and discharging the node Q of the shift register B.

Further, provided is a display device which performs sensing for compensation, which is performed after the display device is powered off. The display device can include: a display panel including a plurality of subpixels; a gate driver which is connected with the subpixels through gate lines including a $j^{th}$ gate line and a $K^{th}$ gate line; and a data driver which is connected to the subpixels through a data line. The gate driver can include: a shift register A which receives an RST2 signal in a global way, receives an LSP A signal and an RST1 A signal in a local way, and is connected with the $j^{th}$ gate line; and a shift register B which receives the RST2 signal in a global way, receives an LSP B signal and an RST1 B signal in a local way, and is connected with the $K^{th}$ gate line.

After the 1 black frame is displayed, the shift register A can perform sensing for compensation for the subpixels connected with the $j^{th}$ gate line, and subsequently the shift register B can perform sensing for compensation for the subpixels connected with the $K^{th}$ gate line.

While the 1 black frame is displayed, the shift register A connected to the $j^{th}$ gate line receives an LSP A signal, and the shift register B connected to the $K^{th}$ gate line receives an LSP B signal.

The receiving the LSP A signal by the shift register A and the receiving the LSP B signal by the shift register B can be sequentially performed.

Before the shift register A performs sensing for compensation for the subpixels connected with the $j^{th}$ gate line, the shift register A receives the RST1 A signal, and a node Q of the shift register A can be charged.

After the shift register A performs sensing for compensation for the subpixels connected with the $j^{th}$ gate line, the shift register A receives the RST2 signal, and the node Q of the shift register A can be discharged.

Before the shift register B performs sensing for compensation for the subpixels connected with the $K^{th}$ gate line, the shift register B receives the RST1 B signal, and a node Q of the shift register B can be charged.

After the shift register B performs sensing for compensation for the subpixels connected with the $K^{th}$ gate line, the shift register B receives the RST2 signal, and the node Q of the shift register B can be discharged.

According to the embodiment of the present invention, a threshold voltage of a driving TFT of a subpixel can be sensed after a display device is powered off According to the embodiment of the present invention, a tact time can be reduced in the sensing of the threshold voltage of the driving TFT of the subpixel.

According to the embodiment of the present invention, the image quality of a display panel can be improved.

DETAILED DESCRIPTION OF THE EMBODIMENTS

Figure 1:
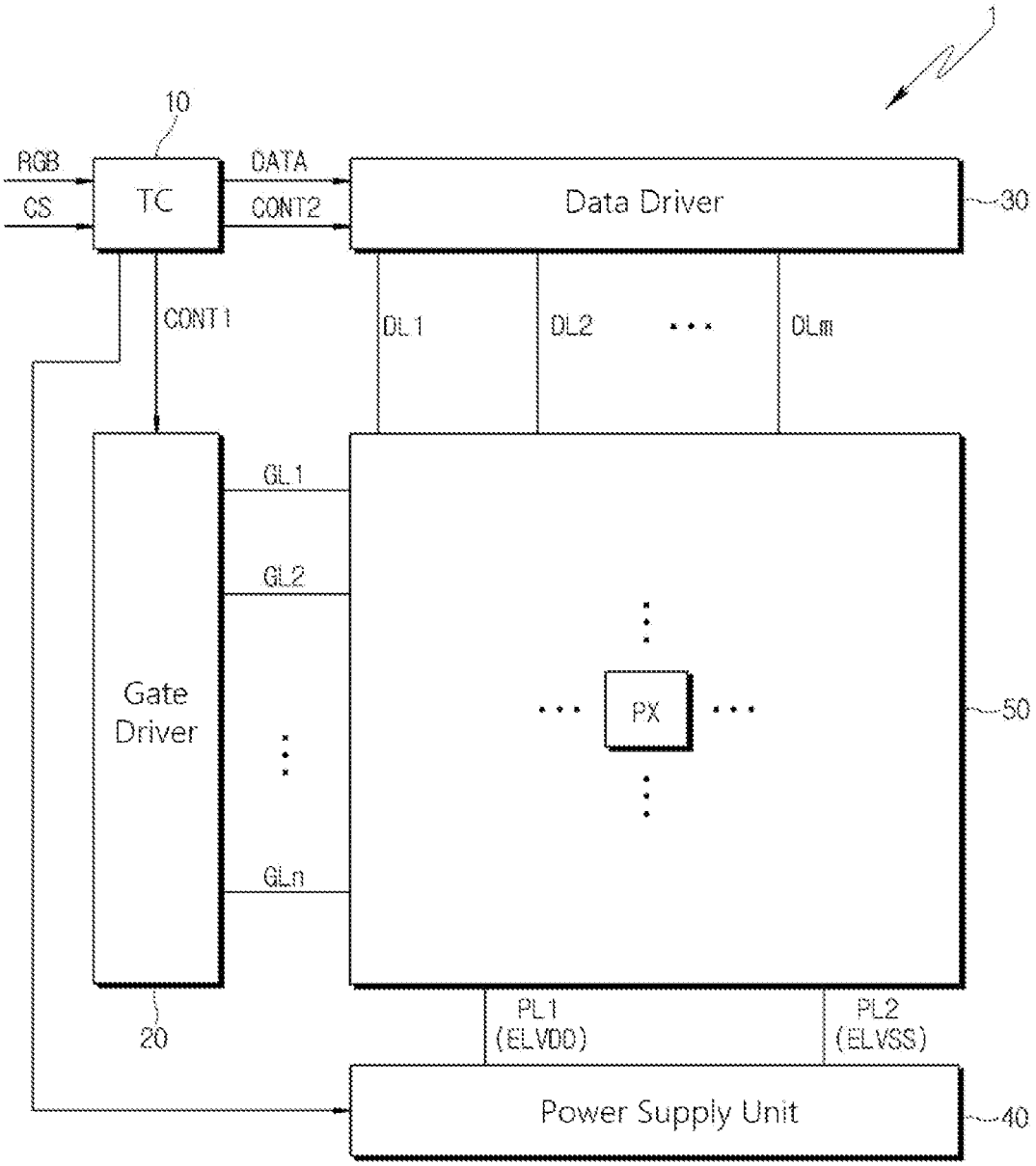
FIG. 1 is a block diagram showing a configuration of a display device according to an embodiment of the present invention.

Hereinafter, embodiments of the present disclosure will be described with reference to the accompanying drawings. In this specification, when it is mentioned that a component (or region, layer, portion) "is on", "is connected to", or "is combined with" another component, terms "is on", "connected to", or "combined with" mean that a component can be directly connected to/combined with another component or mean that a third component can be disposed between them.

The same reference numerals correspond to the same components. Also, in the drawings, the thicknesses, ratios, and dimensions of the components are exaggerated for effective description of the technical details. A term "and/or" includes all of one or more combinations that related configurations can define.

While terms such as the first and the second, etc., can be used to describe various components, the components are not limited by the terms mentioned above. The terms are used only for distinguishing between one component and other components. For example, the first component can be designated as the second component without departing from the scope of rights of various embodiments. Similarly, the second component can be designated as the first component. An expression of a singular form includes the expression of plural form thereof unless otherwise explicitly mentioned in the context.

Terms such as "below", "lower", "above", "upper" and the like are used to describe the relationships between the components shown in the drawings. These terms have relative concepts and are described based on directions indicated in the drawings.

In the present specification, it should be understood that the term "include" or "comprise" and the like is intended to specify characteristics, numbers, steps, operations, components, parts or any combination thereof described in the specification, and intended not to previously exclude the possibility of existence or addition of at least one another characteristics, numbers, steps, operations, components, parts or any combination thereof.

FIG. 1 is a block diagram showing a configuration of a display device according to one or more embodiments of the present invention. All the components of the display device according to all embodiments of the present invention are operatively coupled and configured.

Referring to FIG. 1, a display device 1 includes a timing controller 10, a gate driver 20, a data driver 30, a power supply unit 40, and a display panel 50.

The timing controller 10 can receive an image signal RGB and a control signal CS from the outside. The image signal RGB can include a plurality of gradation data. The control signal CS can include, for example, a horizontal synchronization signal, a vertical synchronization signal, and a main clock signal.

The timing controller 10 can process the image signal RGB and the control signal CS in conformity with operation conditions of the display panel 50, and then can output an image data (DATA), a gate driving control signal CONT1, a data driving control signal CONT2, a power supply control signal CONT3.

The gate driver 20 can be connected with pixels PX of the display panel 50 through a plurality of gate lines GL1 to GLn where n can be a positive number such as a positive integer. The gate driver 20 can generate gate signals on the basis of the gate driving control signal CONT1 output from the timing controller 10. The gate driver 20 can provide the generated gate signals to the pixels PX through the plurality of gate lines GL1 to GLn.

The data driver 30 can be connected with the pixels PX of the display panel 50 through a plurality of data lines DL1 to DLm, where m can be a positive number such as a positive integer. The data driver 30 can generate data signals on the basis of the image data (DATA) and the data driving control signal CONT2 output from the timing controller 10. The data driver 30 can output the generated data signals to the pixels PX through the plurality of data lines DL1 to DLm.

The power supply unit 40 can be connected with the pixels PX of the display panel 50 through a plurality of power lines PL1 and PL2. The power supply unit 40 can generate a driving voltage supplied to the display panel 50, on the basis of the power supply control signal CONT3. The driving voltage can include, for example, a high potential driving voltage (ELVDD) and a low potential driving voltage (ELVSS). The power supply unit 40 can provide the generated driving voltages ELVDD and ELVSS to the pixels PX through the power lines PL1 and PL2 corresponding thereto.

A plurality of the pixels PX are disposed on the display panel 50. For example, the pixels PX can be disposed on the display panel 50 in the form of a matrix.

Each pixel PX can be electrically connected to the gate line and the data line which correspond thereto. Such pixels PX can emit light with a luminance which corresponds to the gate signal and the data signal which are provided through the gate lines GL1 to GLn and the data lines DL1 to DLm.

Each pixel PX can represent any one of a first to third colors. For example, each pixel PX can represent any one of red, green, and blue colors. For another example, each pixel PX can represent any one of cyan, magenta and yellow colors. For further another example, the pixels PX can represent any one of four or more colors. For instance, each pixel PX can represent any one of red, green, blue, and white colors.

The timing controller 10, the gate driver 20, the data driver 30, and the power supply unit 40 can be configured as a separate integrated circuit (IC) respectively or can be configured as an IC in which at least some of them are integrated. For example, at least one of the data driver 30 and the power supply unit 40 can be configured as an IC integrated with the timing controller 10.

Also, while the gate driver 20 and the data driver 30 are shown in FIG. 1 as separate components from the display panel 50, at least one of the gate driver 20 and the data driver 30 can be implemented in an in-panel method where it is formed integrally with the display panel 50. For example, the gate driver 20 can be formed integrally with the display panel 50 in a gate-in-panel (GIP) method.

Figure 2:
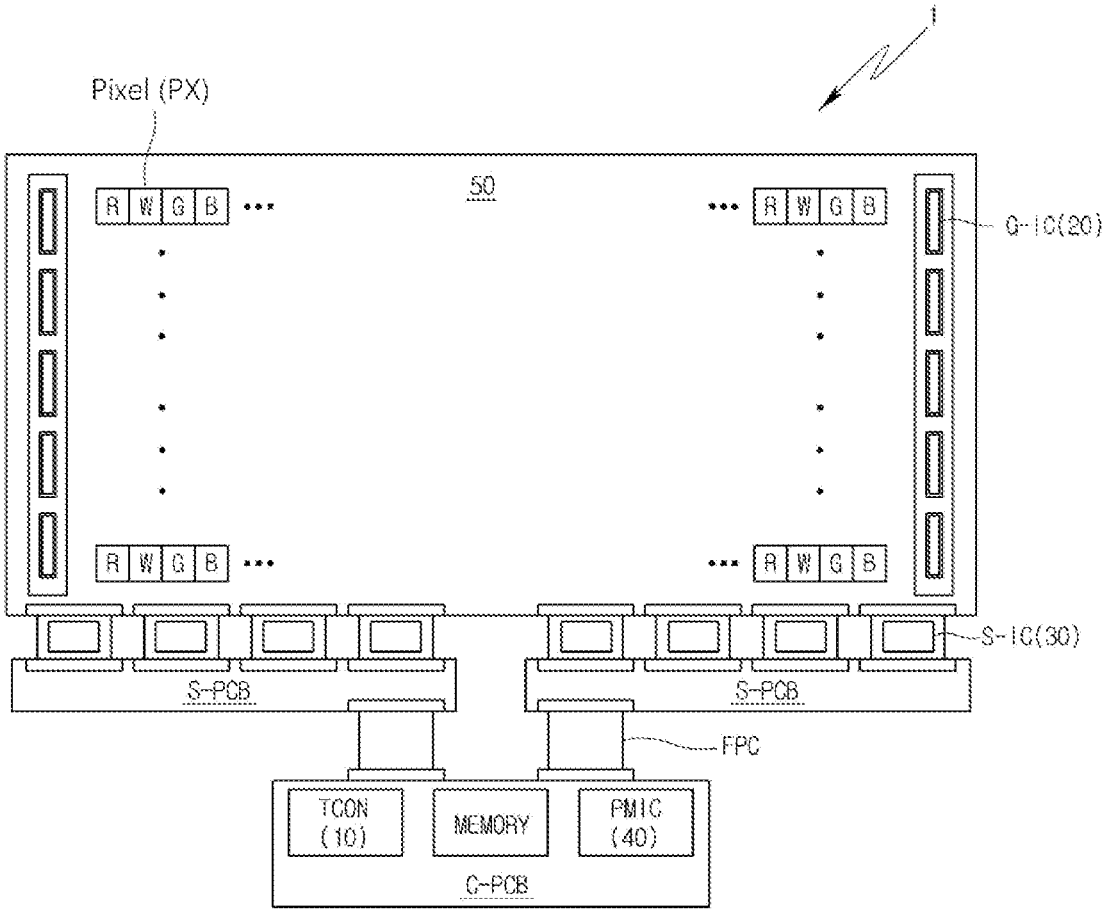
FIG. 2 is a view showing the display panel according to the embodiment of the present invention.

FIG. 2 is a view showing the display panel according to the embodiment of the present invention.

Referring to FIG. 2, the rectangular display panel 50 is shown and the display panel 50 includes a plurality of the pixels PX arranged therewithin in the form of columns and rows. For example, the plurality of pixels PX can include four subpixels, and the four subpixels can be a red subpixel, a white subpixel, a green subpixel, and a blue subpixel, respectively.

The display device 1 includes the gate driving IC (G-IC) 20. The display panel 50 can be implemented in a gate-in-panel (GIP) method in which the gate driving IC 20 is disposed within the display panel. The gate driving IC 20 can be attached to the left, right or right and left sides of the display panel 50.

The display device 1 further includes the data driving IC (source driving IC: S-IC) 30. The source driving IC 30 can be attached below the display panel 50. A plurality of the source driving ICs 30 can be attached in the transverse direction of the display panel 50. Such a source driving IC 30 can be implemented in a chip on film (COF) method where it is disposed within a flexible PCB (FPCB), a chip on glass (COG) method where it is disposed on a glass substrate constituting the display panel 50, and the like. For example, in the embodiment shown in FIG. 2, the source driving IC 30 is implemented in the COF method, and the FPCB connects the display panel 50 and a source PCB (S-PCB) through pad connection. The source driving IC 30 can transmit a voltage (source IC driving voltage, EVDD, EVSS, VREF, etc.) provided to the display panel 50 from a control PCB (C-PCB).

The source PCB (S-PCB) can be connected to the display panel 50 from below the display panel 50 through the FPCB, and can be connected to the control PCB (C-PCB) through a flexible plat cable (FPC) connection. The source PCB (S-PCB) is directly connected to the source driving IC 30 and transmits the gate signal to the gate driving IC 20. Also, the source PCB (S-PCB) receives power (ELVDD, ELVSS, VGH, VHL, VREF, etc.) from the control PCB (C-PCB) and transmits it to the display panel 50. Also, a connection between the control PCB (C-PCB) and the gate driving IC 20 is provided through the leftmost or rightmost source driving IC 30 of the source PCB (S-PCB). For example, a gate driving IC driving voltage, a gate high voltage (VGH), a gate low voltage (VGL), etc., are transferred from the control PCB (C-PCB) to the gate driving IC 20 through the source PCB (S-PCB).

The control PCB (C-PCB) is disposed below the display panel 50 and is connected to the display panel 50 through the source PCB (S-PCB) and the cable (FPC). The control PCB (C-PCB) can include the timing controller (TCON) 10, the power supply unit 40, and a memory. The description of the timing controller 10 and the power supply unit 40 is the same as the description with reference to FIG. 1. Also, the control PCB (C-PCB) calculates an algorithm for every frame of an output image data to be output, stores compensation data, and requires an area for storing various parameters required for the algorithm calculation or various parameters for tuning. Accordingly, a volatile memory and/or a non-volatile memory can be placed on the control PCB (C-PCB).

Figure 3:
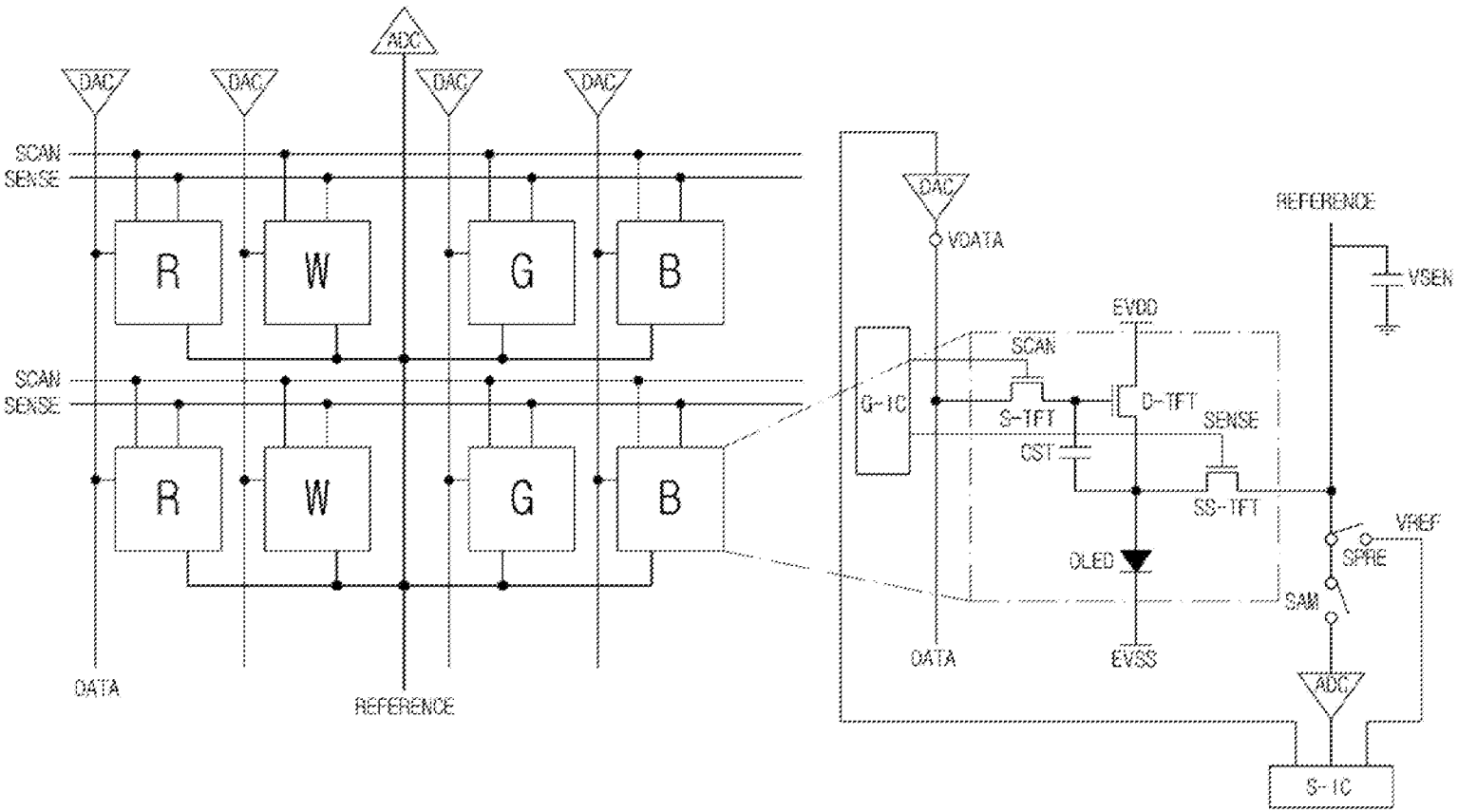
FIG. 3 is view for describing a structure of a pixel according to the embodiment of the present invention.

FIG. 3 is view for describing a structure of the pixel according to the embodiment of the present invention.

Referring to FIG. 3, one pixel includes four subpixels R, W, G, and B, and each of the subpixels is connected to the gate driving IC (G-IC), a scan line SCAN, and a sensing line SENSE, and is connected through the source driving IC (S-IC) and a reference line. Also, each subpixel receives a data voltage VDATA from the source driving IC (S-IC) through a digital analog converter (DAC). Also, a sensing voltage VSEN output from each subpixel is provided to the source driving IC (S-IC) through an analog digital converter (ADC). Also, each subpixel is connected to the high potential driving voltage (ELVDD) and the low potential driving voltage (ELVSS).

Each subpixel includes a scan TFT (S-TFT), a driving TFT (D-TFT), and a sensing TFT (SS-TFT). Also, each subpixel includes a storage capacitor CST and a light emitting device (OLED).

A first electrode (e.g., a source electrode) of the scan transistor (S-TFT) is connected to the data lines DATA and DL, and the data voltage VDATA is output from the source driving IC (S-IC) and is applied to the data line through the DAC. A second electrode (e.g., a drain electrode) of the scan transistor (S-TFT) is connected to one end of the storage capacitor CST and is connected to a gate electrode of the driving TFT (D-TFT). The gate electrode of the scan transistor (S-TFT) is connected to the scan line (or the gate line GL). For example, the scan transistor (S-TFT) is turned on when the gate signal at a gate-on level is applied through the scan line SCAN, so that the data signal applied through the data line DATA is transferred to one end of the storage capacitor CST.

One end of the storage capacitor CST is connected to a third electrode (e.g., a drain electrode) of the scan TFT (S-TFT). The other end of the storage capacitor CST is configured to receive the high potential driving voltage ELVDD. The storage capacitor CST can charge a voltage corresponding to a difference between a voltage applied to one end thereof and the high potential driving voltage ELVDD applied to the other end thereof. Also, the storage capacitor CST can charge a voltage corresponding to a difference between the voltage applied to one end thereof and a reference voltage VREF applied to the other end thereof through a switch SPRE and the sensing TFT (SS-TFT).

A first electrode (e.g., a source electrode) of the driving transistor (D-TFT) is configured to receive the high potential driving voltage ELVDD, and a second electrode (e.g., a drain electrode) is connected to a first electrode (e.g., an anode electrode) of the light emitting device (OLED). A third electrode (e.g., a gate electrode) of the driving transistor (D-TFT) is connected to one end of the storage capacitor CST. The driving transistor (D-TFT) is turned on when a voltage at the gate-on level is applied, and can control an amount of a driving current flowing through the light emitting device (OLED) in response to a voltage provided to the gate electrode. For example, the current is determined by a voltage difference in the driving TFT (D-TFT) Vgs (or a storage voltage difference in the storage capacitor CST) and is applied to the light emitting element (OLED).

A first electrode (e.g., a source electrode) of the sensing TFT (SS-TFT) is connected to the reference line REFERENCE, and a second electrode (e.g., a drain electrode) is connected to the other end of the storage capacitor CST. A third electrode (e.g., a gate electrode) is connected to the sensing line SENSE. For example, the sensing TFT (SS-TFT) is turned on by a sensing signal SENSE output from the gate driving IC (G-IC) and applies the reference voltage VREF to the other end of the storage capacitor CST. If both the switch SPRE and a switch SAM are turned off and the sensing TFT (SS-TFT) is turned on, the storage voltage of the storage capacitor CST is transferred to the capacitor of the reference line, and the sensing voltage VSEN is stored in the capacitor of the reference line.

If the switch SPRE is turned off and the switch SAM is turned on, the voltage VSEN stored in the reference line capacitor is output to the source driving IC (S-IC) through the ADC. This output voltage is used soon as a voltage for sensing and sampling the degradation of a corresponding subpixel. For example, a voltage for compensating for a corresponding subpixel can be sensed and sampled. Specifically, the characteristics of the driving TFT (D-TFT) are classified into two types of mobility and threshold voltage, and the compensation can be implemented by sensing the mobility and threshold voltage of the driving TFT (D-TFT). Also, the characteristics of the corresponding subpixel can be also determined by the degradation of the light emitting element (OLED), and it is necessary to sense and compensate for the degree of degradation of the light emitting element (OLED). Hereinafter, each driving method for each type of compensation will be described.

Meanwhile, the light emitting device (OLED) outputs light corresponding to the driving current. The light emitting element (OLED) can output light corresponding to any one of red, white, green, and blue colors. The light emitting device (OLED) can be an organic light emitting diode (OLED) or a micro inorganic light emitting diode having a size in a range from micro scale to nano scale. However, the light emitting device (OLED) of the present invention is not limited thereto. Hereinafter, the technical spirit of the present invention will be described with reference to the embodiment in which the light emitting device (OLED) is composed of the organic light emitting diode.

FIG. 3 shows an example in which a switching transistor (ST), the driving transistor (D-TFT), and the sensing transistor SS-TFT are NMOS transistors. However, the present invention is not limited thereto. For example, at least some or all of the transistors constituting each pixel PX can be composed of a PMOS transistor. In various embodiments, each of the switching transistor (ST) and the driving transistor (D-TFT) can be implemented with a low temperature poly silicon (LTPS) thin film transistor, an oxide thin film transistor, or a low temperature polycrystalline oxide (LTPO) thin film transistor.

In the description with reference to FIG. 3, it is shown that four subpixels share one reference line. However, the present invention is not limited thereto. A multiple number of subpixels can share one reference line REFERENCE, or each subpixel can be connected to one reference line REFERENCE. In the present specification, for convenience of description, as shown in FIG. 3, it is described that four subpixels share one reference line REFERENCE, and it should be construed as an example.

FIGS. 4A to 4D are views for describing compensation for a mobility feature when the display device is initially driven. For example, the compensation in the present description is performed during a short period of time before the image data is output after the display device is powered on. Also, the compensation in the present description corresponds to compensation for correcting the deviation by sensing the mobility feature of the driving TFT.

Figure 4A:
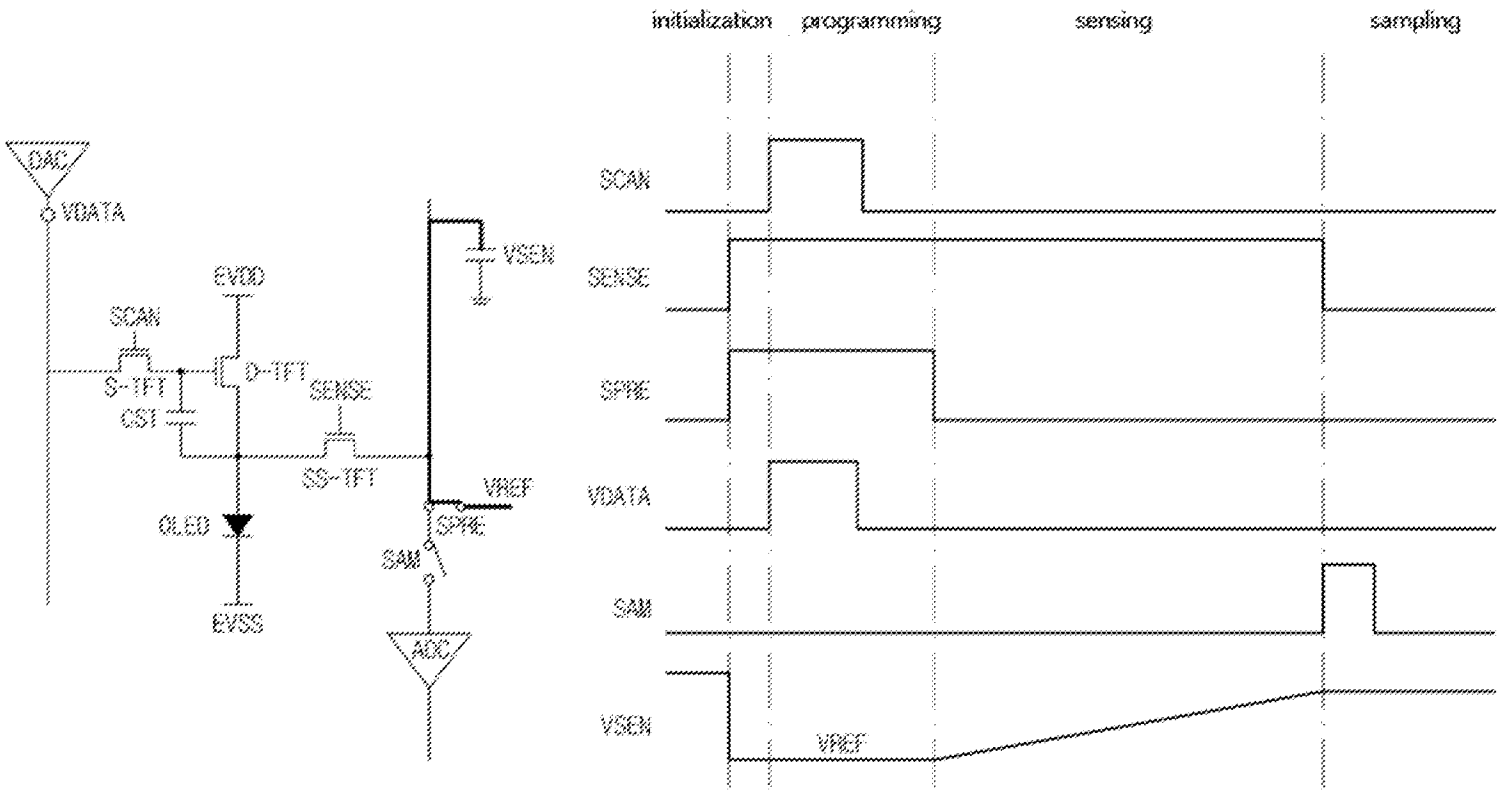
FIGS. 4A to 4D are views for describing compensation for a mobility feature when the display device is initially driven.

Referring to FIG. 4A, the switch SPRE is turned on in an initialization period. Accordingly, the sensing voltage VSEN stored in the capacitor of the reference line is equal to the reference voltage VREF.

Figure 4B:
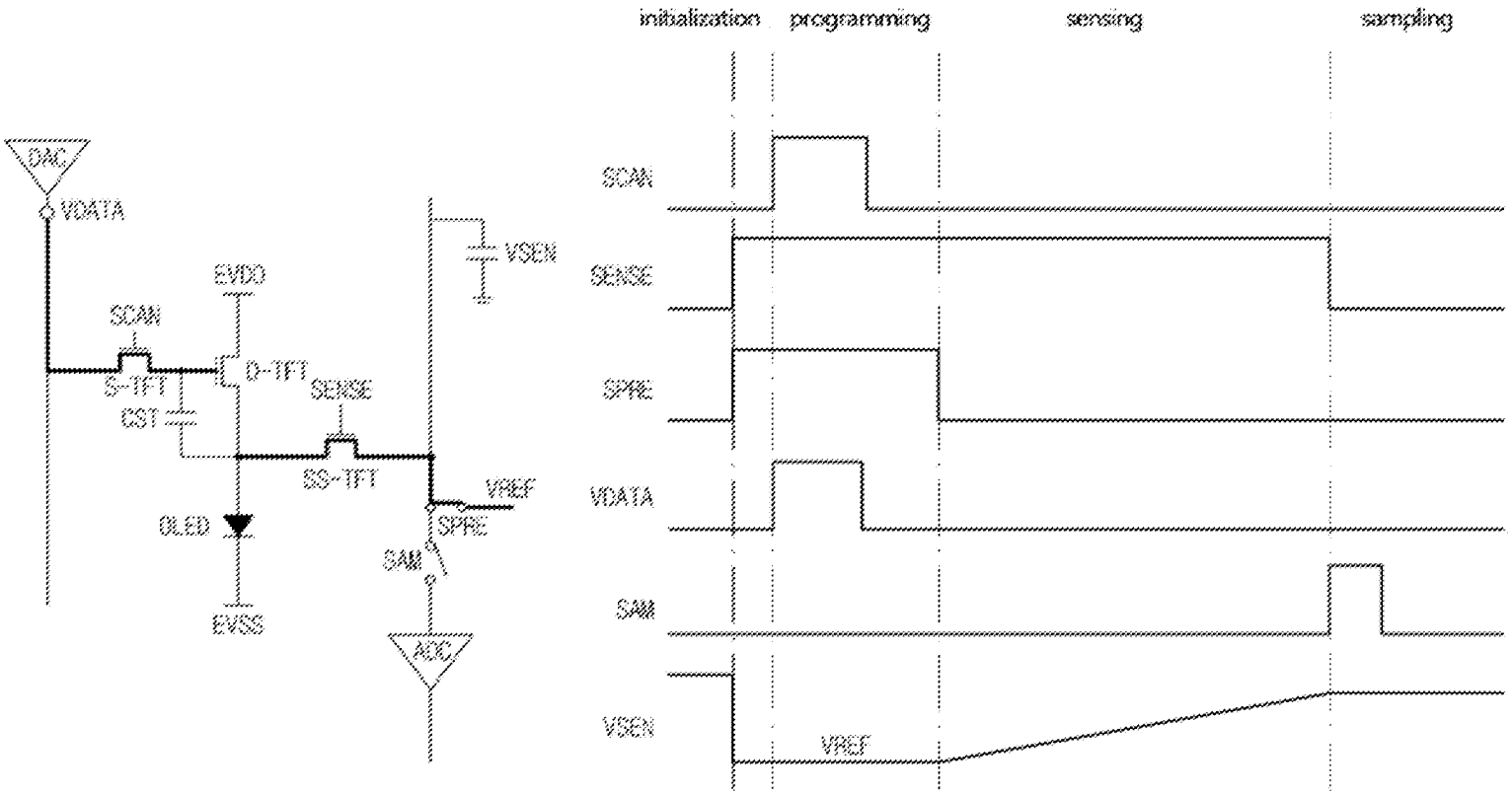

Referring to FIG. 4B, the scan TFT (S-TFT) is turned on in a programming period. Also, the data voltage VDATA is a high voltage. Accordingly, a charge corresponding to the data voltage VDATA is charged at one end of the storage capacitor CST. Also, in the programming period, the sensing TFT (SS-TFT) is turned on and the switch SPRE is turned on. Accordingly, the other end of the storage capacitor CST is charged with a charge corresponding to the reference voltage VREF. For example, the voltage across the storage capacitor CST corresponds to a difference between the data voltage VDATA and the reference voltage VREF. Meanwhile, since the switch SPRE is maintained to be turned on, the sensing voltage VSEN is maintained as the reference voltage VREF.

Figure 4C:
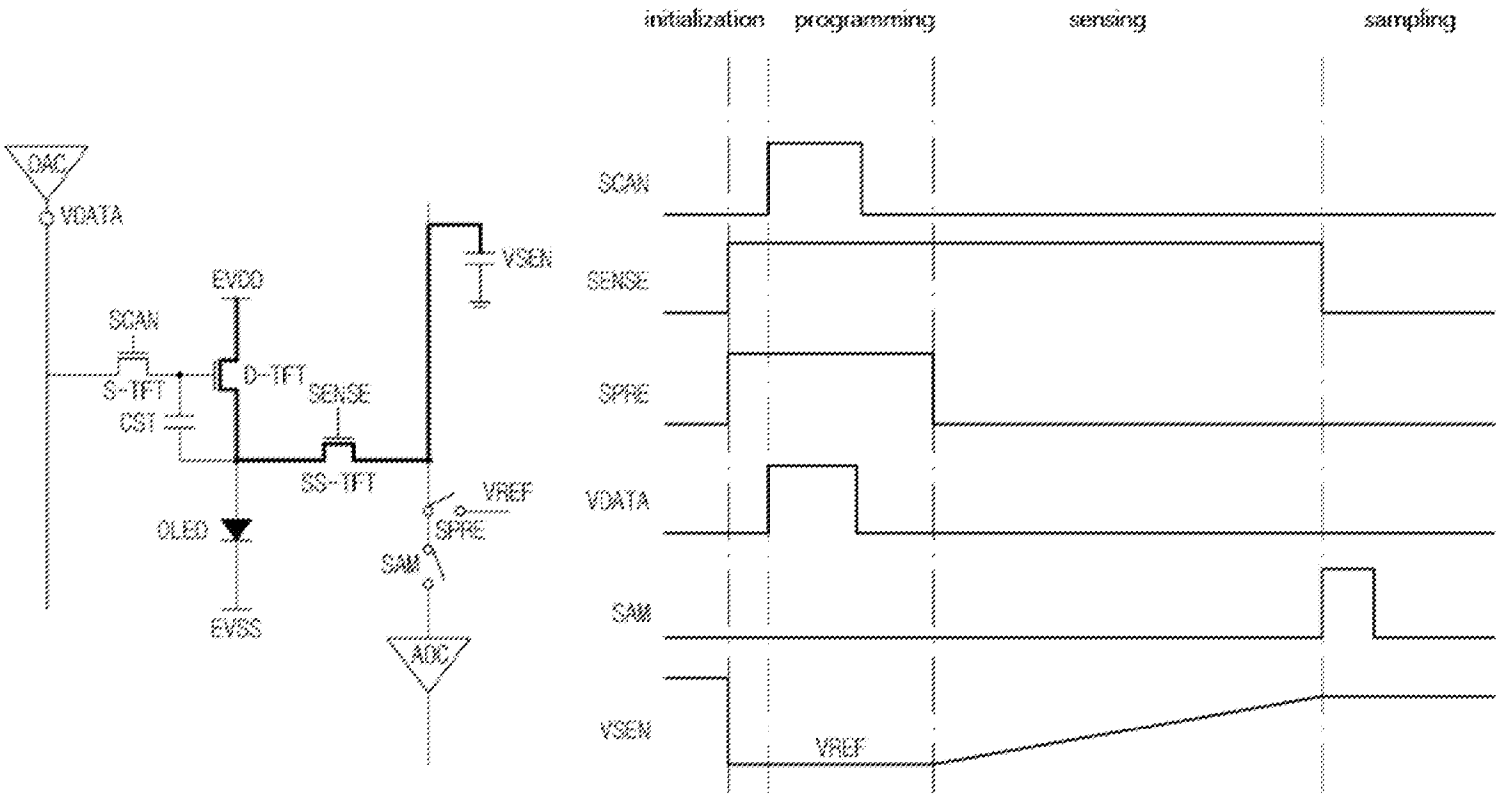

Referring to FIG. 4C, in a sensing period, the scan TFT (S-TFT) is turned off and the sensing TFT (SS-TFT) is turned on. Accordingly, the driving TFT (D-TFT) operates like a constant current source with a constant magnitude, and the current is applied to a reference capacitor through the sensing TFT (SS-TFT). Accordingly, the sensing voltage VSEN increases with a constant voltage increase over time.

Figure 4D:
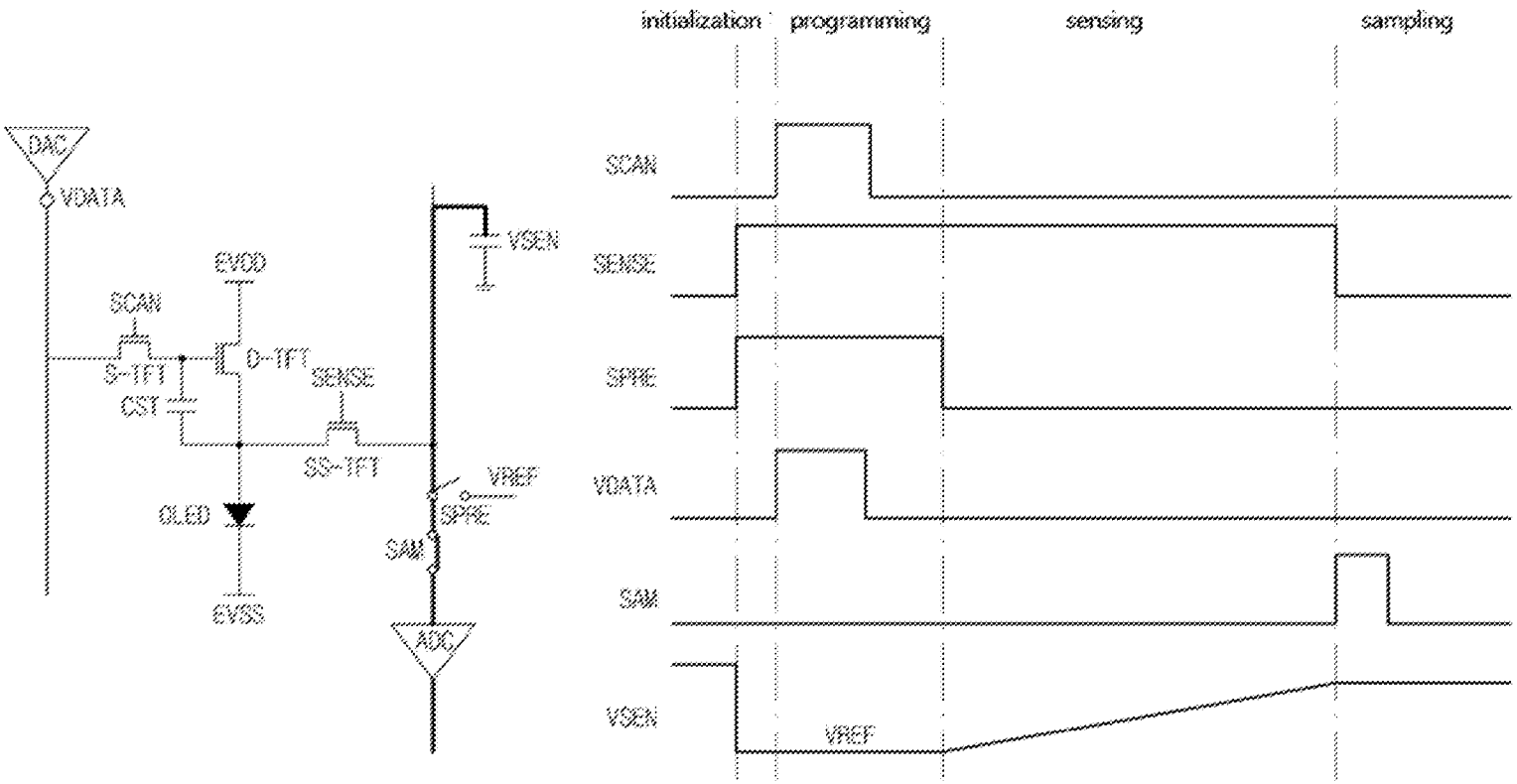

Referring to FIG. 4D, in a sampling period, the sensing TFT (SS-TFT) is turned off and the switch SAM is turned on. Accordingly, the sensing voltage VSEN is applied to the source driving IC (S-IC) via the ADC through the reference line REFERENCE. The source driving IC (S-IC) to which the sensing voltage VSEN is applied can calculate the mobility features of the corresponding driving TFT.

FIGS. 5A to 5E are views for describing compensation for the mobility feature while the display device is driven. For example, the compensation in the present description is performed while the display device is powered on and the image data is being output. Also, the compensation in the present description corresponds to compensation for correcting the deviation by sensing the mobility feature of the driving TFT.

The sensing of the mobility features during the driving of the display device can be performed in a blank period between one frame and the next frame. Also, since four subpixels share one reference line, it is preferable that the sensing of the four subpixels is not simultaneously performed. Also, it is preferable that subpixels having one color among the subpixels connected to a certain gate line are sensed in a blank period and subpixels having other colors among the subpixels connected to the gate line are sensed in the next blank period. This is because all the subpixels connected to the gate line can not be sensed since the blank period is short.

Figure 5A:
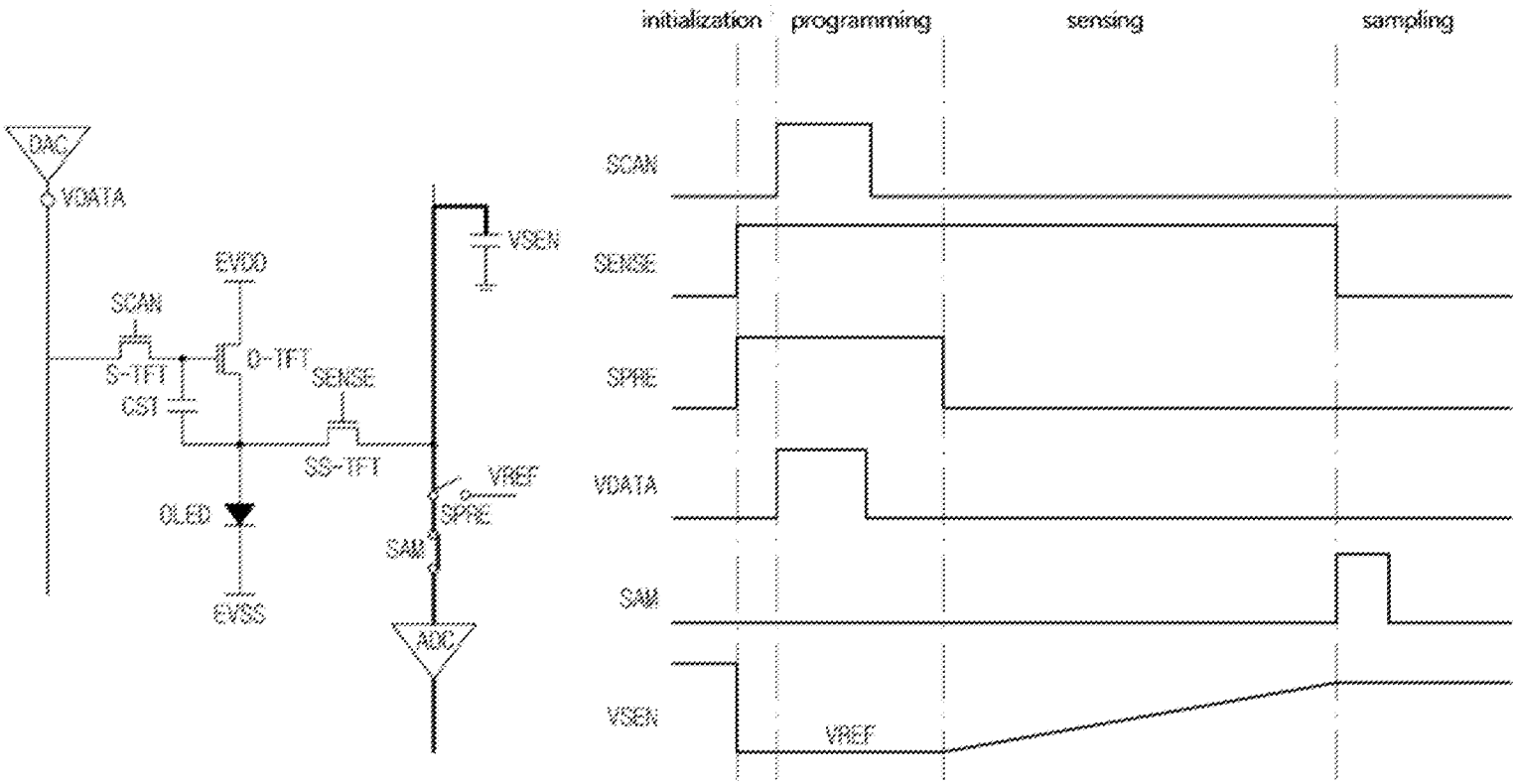
FIGS. 5A to 5E are views for describing compensation for the mobility feature while the display device is driven.

Referring to FIG. 5A, the switch SPRE is turned on in the initialization period. Accordingly, the sensing voltage VSEN stored in the capacitor of the reference line is equal to the reference voltage VREF.

Figure 5B:
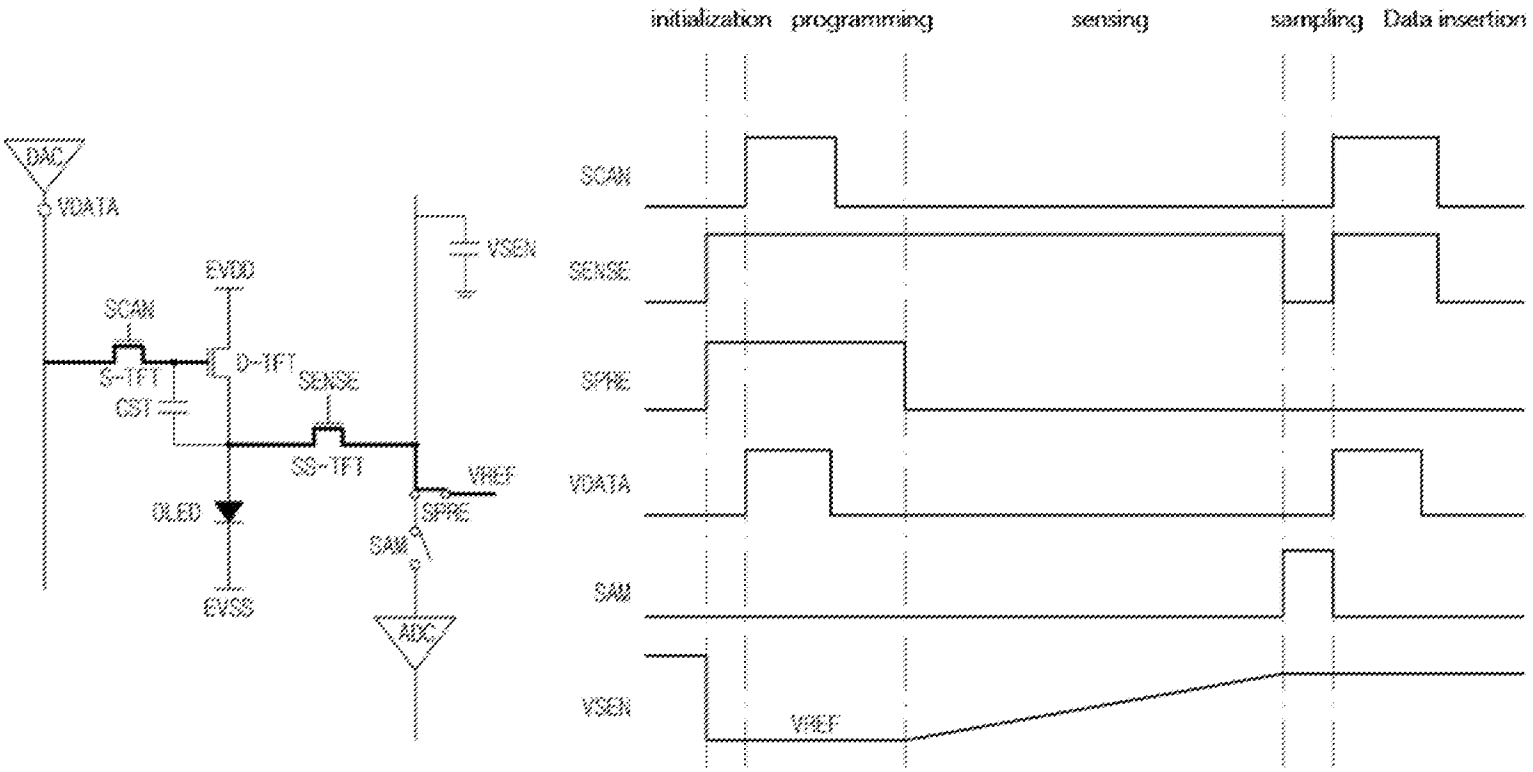

Referring to FIG. 5B, the scan TFT (S-TFT) is turned on in a programming period. Also, the data voltage VDATA is a high voltage. Accordingly, a charge corresponding to the data voltage VDATA is charged at one end of the storage capacitor CST. Also, in the programming period, the sensing TFT (SS-TFT) is turned on and the switch SPRE is turned on. Accordingly, the other end of the storage capacitor CST is charged with a charge corresponding to the reference voltage VREF. For example, the voltage across the storage capacitor CST corresponds to a difference between the data voltage VDATA and the reference voltage VREF. Meanwhile, since the switch SPRE is maintained to be turned on, the sensing voltage VSEN is maintained as the reference voltage VREF.

Figure 5C:
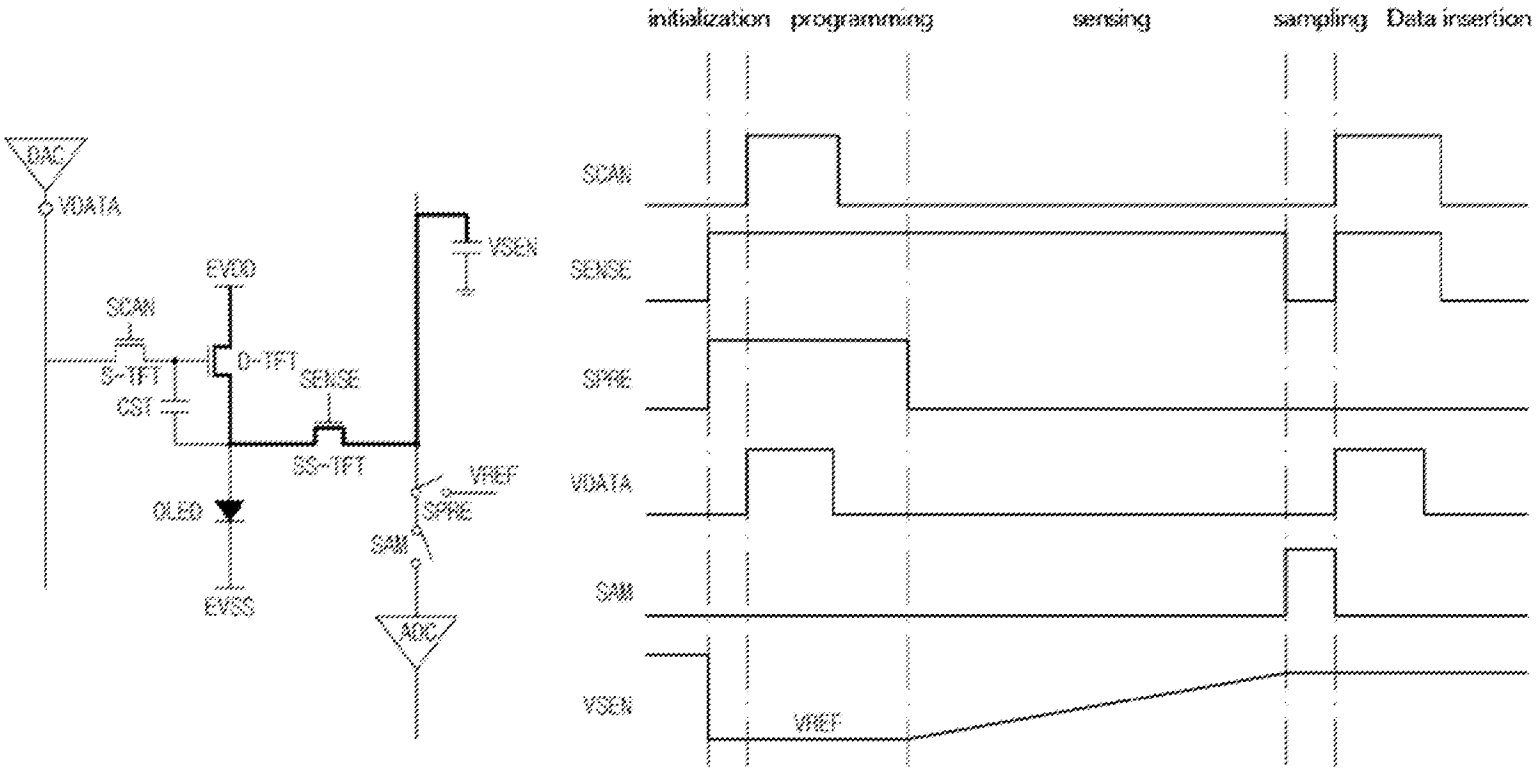

Referring to FIG. 5C, in the sensing period, the scan TFT (S-TFT) is turned off and the sensing TFT (SS-TFT) is turned on. Accordingly, the driving TFT (D-TFT) operates like a constant current source with a constant magnitude, and the current is applied to the reference capacitor through the sensing TFT (SS-TFT). Accordingly, the sensing voltage VSEN increases with a constant voltage increase over time.

Figure 5D:
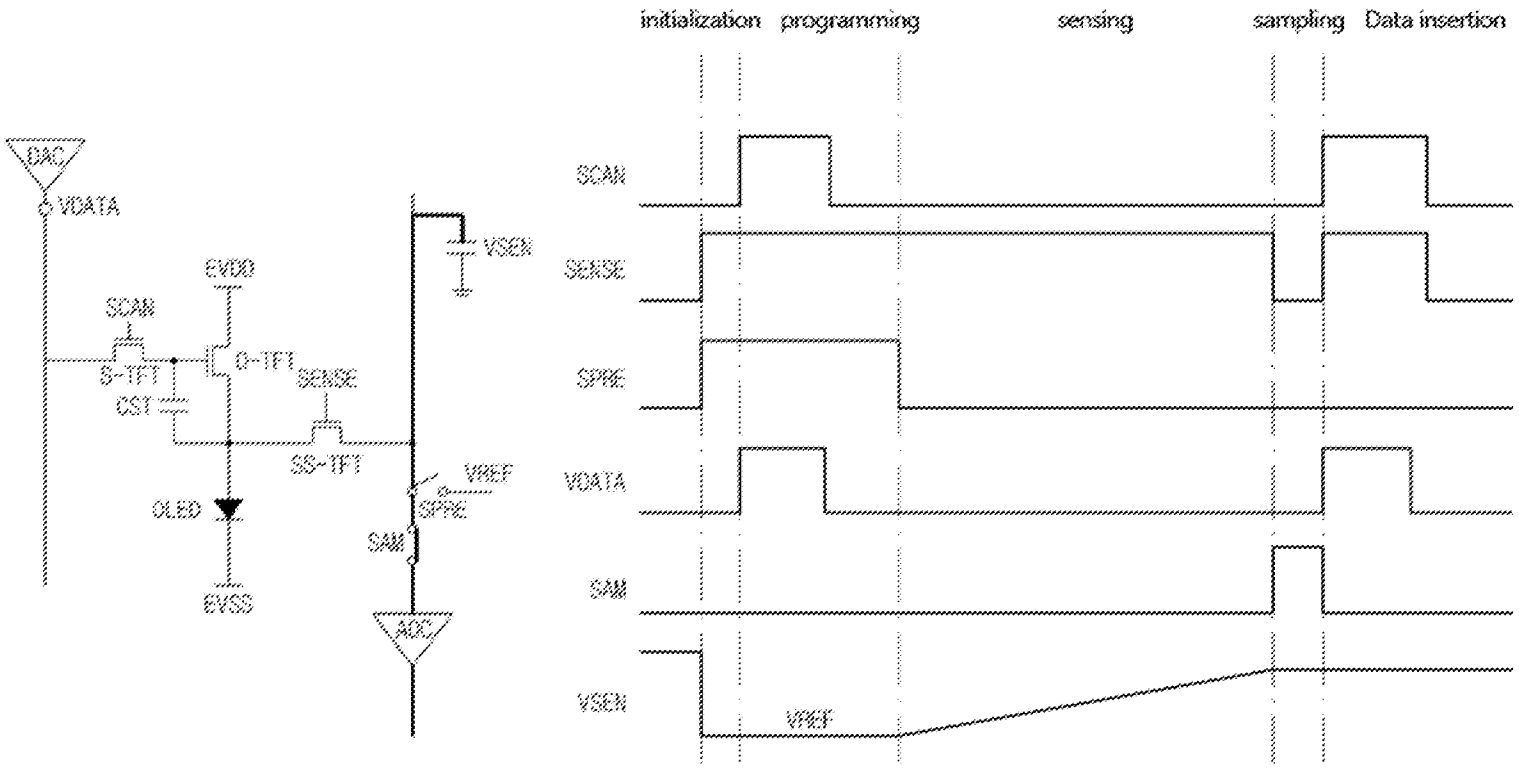

Referring to FIG. 5D, in the sampling period, the sensing TFT (SS-TFT) is turned off and the switch SAM is turned on. Accordingly, the sensing voltage VSEN is applied to the source driving IC (S-IC) via the ADC through the reference line REFERENCE. The source driving IC (S-IC) to which the sensing voltage VSEN is applied can calculate the mobility features of the corresponding driving TFT.

Figure 5E:
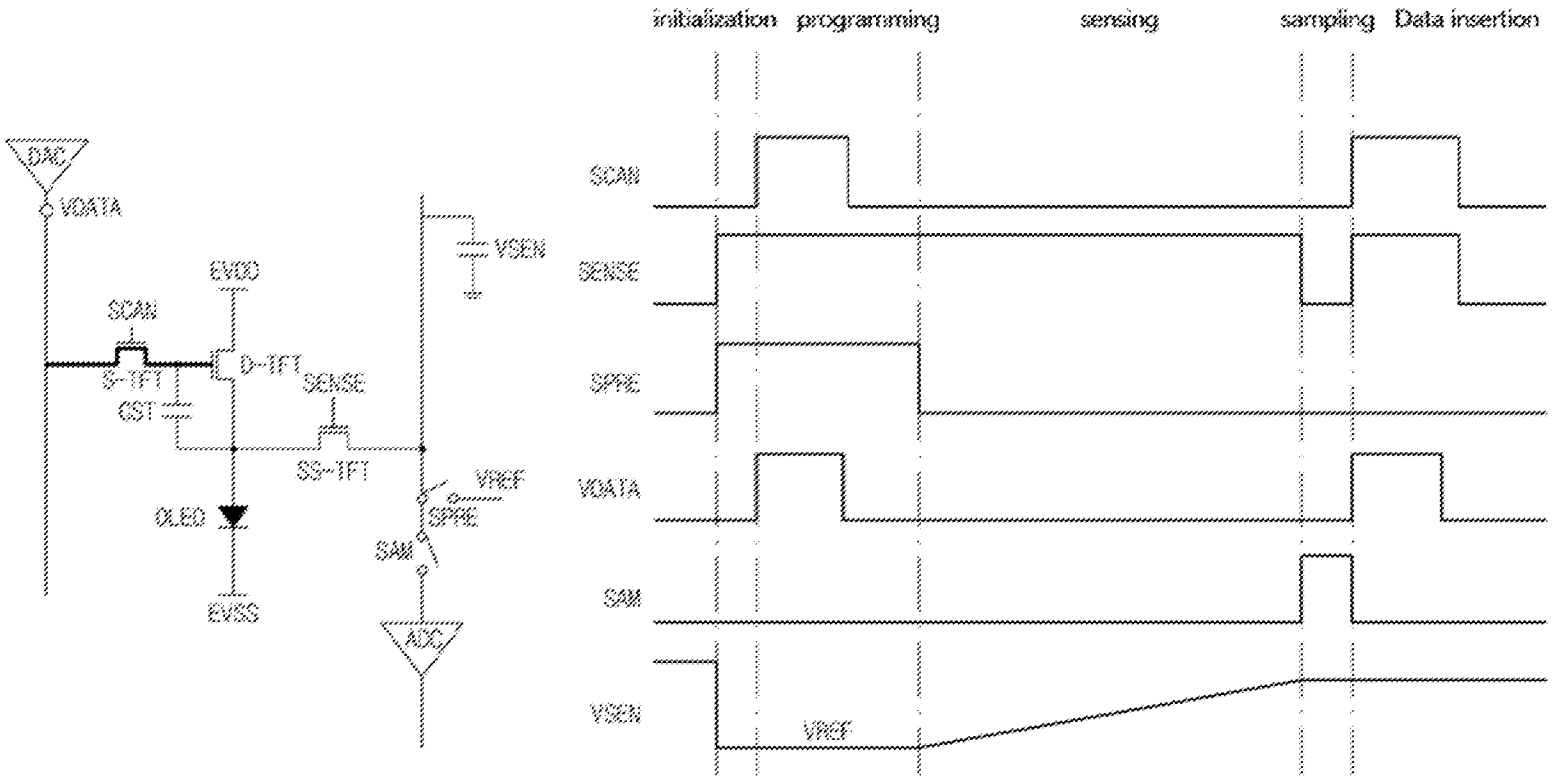

Meanwhile, referring to FIG. 5E, in a data insertion period after the sampling period, the scan TFT (S-TFT) is turned on and the data voltage VDATA is a high voltage. For example, since a real-time compensation is performed, the process of FIGS. 5A to 5D is performed during the blank period between frame and frame. A luminance deviation from another data line charged with an existing data voltage occurs. In order to correct the luminance deviation, the data of the previous frame is restored after the sampling period.

FIGS. 6A to 6D are views for describing compensation for a threshold voltage characteristic after the display device is powered off. For example, the compensation in the present description is performed while the display device is powered off and the image data is not output. Also, the compensation in the present description corresponds to compensation for correcting the deviation by sensing the threshold voltage characteristic of the driving TFT.

The sensing of the threshold voltage characteristic after the display device is powered off can be performed in a state in which the power of the display device is not turned off and a black screen is displayed even though a user has turned off the display device. Since the four subpixels share one reference line, it is preferable that the sensing of the four subpixels is not simultaneously performed. Therefore, it is preferable that subpixels having one color among the subpixels connected to a certain gate line are sensed and subsequently subpixels having other colors are sensed and all the subpixels of the corresponding gate line are sensed and then the next gate line is sensed. This is because, unlike real-time sensing, this case is free from time constraints.

Figure 6A:
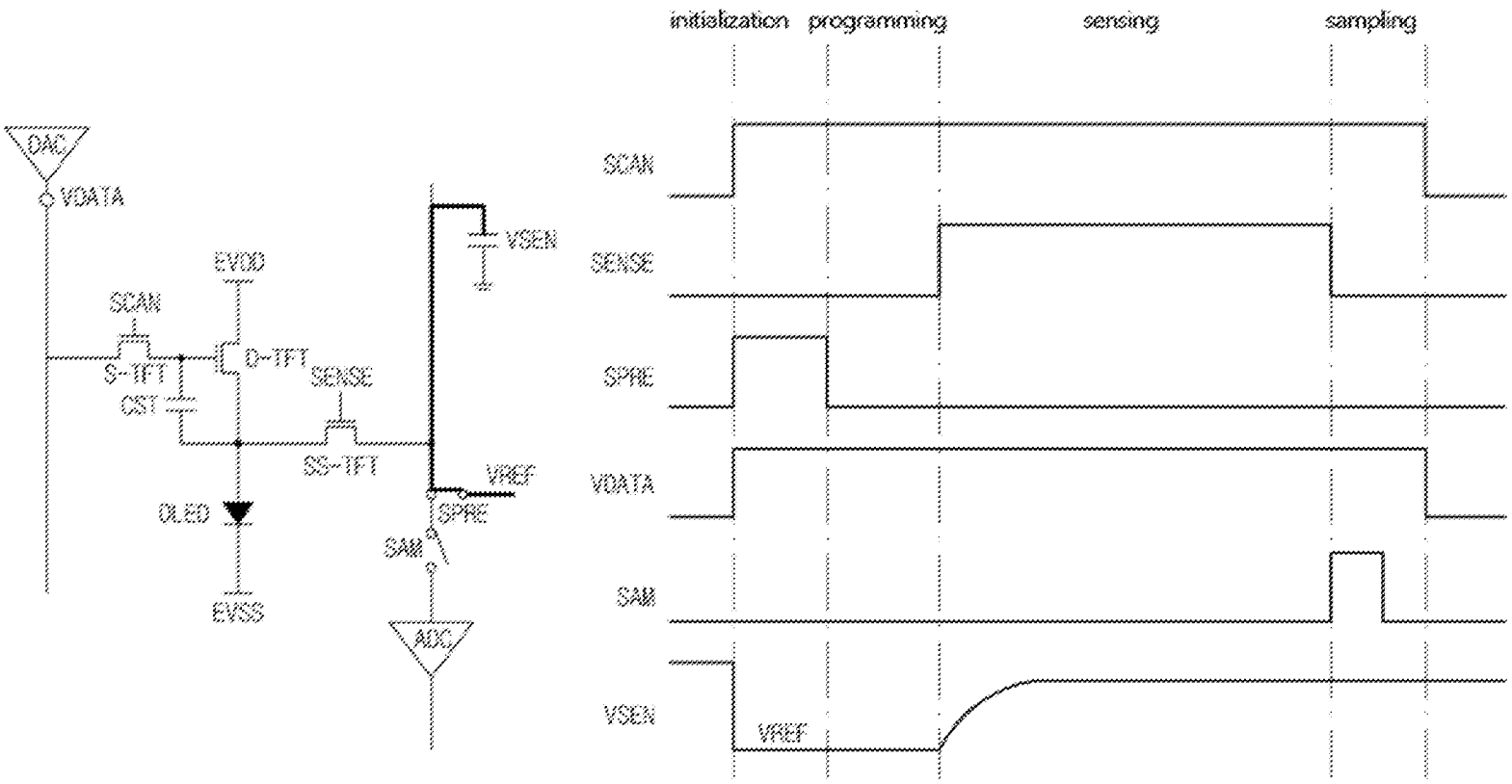
FIGS. 6A to 6D are views for describing compensation for a threshold voltage characteristic after the display device is powered off.

Referring to FIG. 6A, the switch SPRE is turned on in the initialization period. Accordingly, the sensing voltage VSEN stored in the capacitor of the reference line is equal to the reference voltage VREF.

Figure 6B:
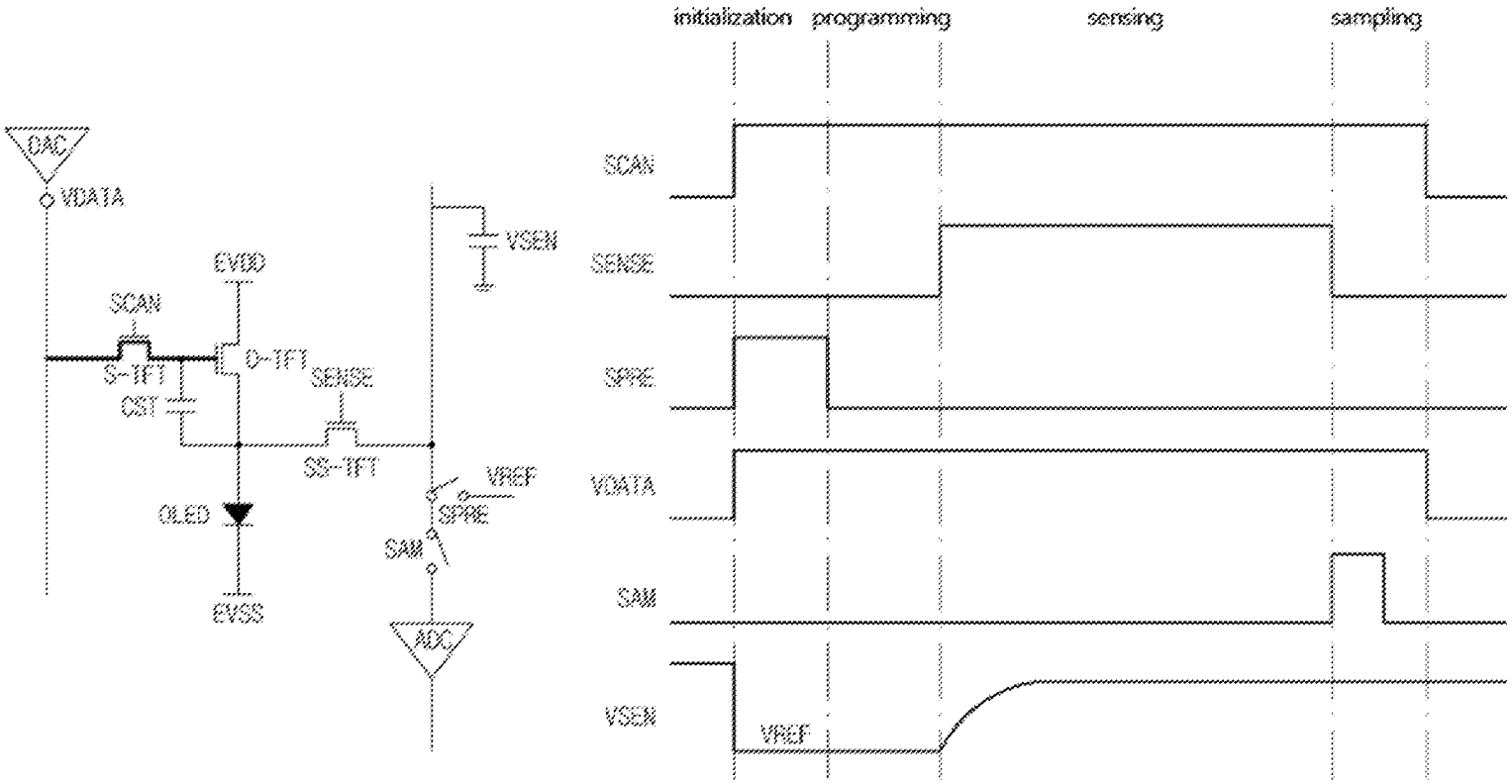

Referring to FIG. 6B, the scan TFT (S-TFT) is turned on in a programming period. Also, the data voltage VDATA is a high voltage. Accordingly, a charge corresponding to the data voltage VDATA is charged at one end of the storage capacitor CST. Also, the other end of the storage capacitor CST is floating. Therefore, due to the capacitor characteristics, the voltage at the other end of the storage capacitor CST increases at the same rate as that at which the voltage at one end of the storage capacitor CST increases.

Figure 6C:
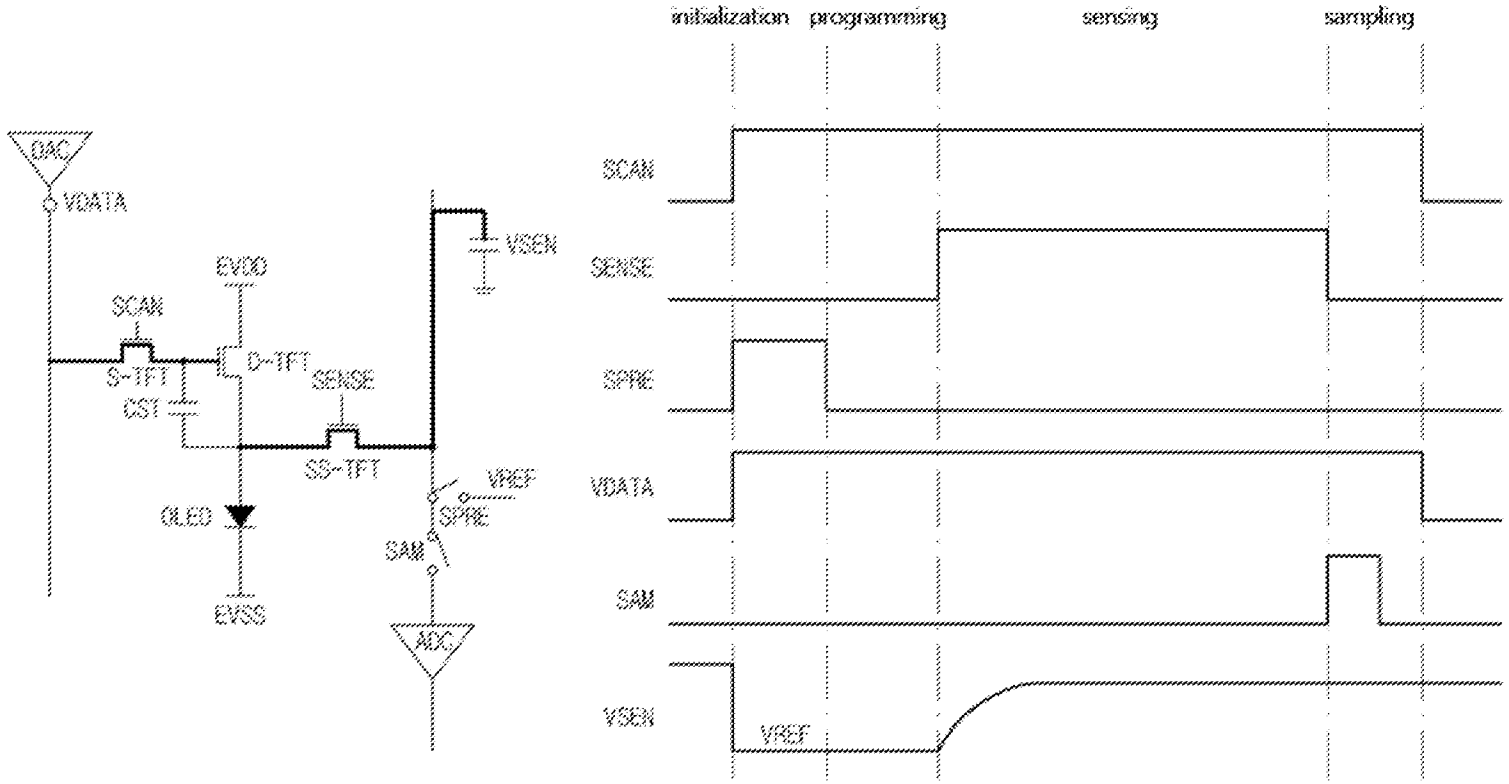

Referring to FIG. 6C, in the sensing period, the scan TFT (S-TFT) is maintained to be turned on and the data voltage VDATA is maintained high. Accordingly, a charge corresponding to the data voltage VDATA is continuously charged at one end of the storage capacitor CST. In the sensing period, the sensing TFT (SS-TFT) is turned on. Accordingly, the sensing voltage VSEN increases in the same way as that in which the voltage at the other end of the storage capacitor CST increases.

Figure 6D:
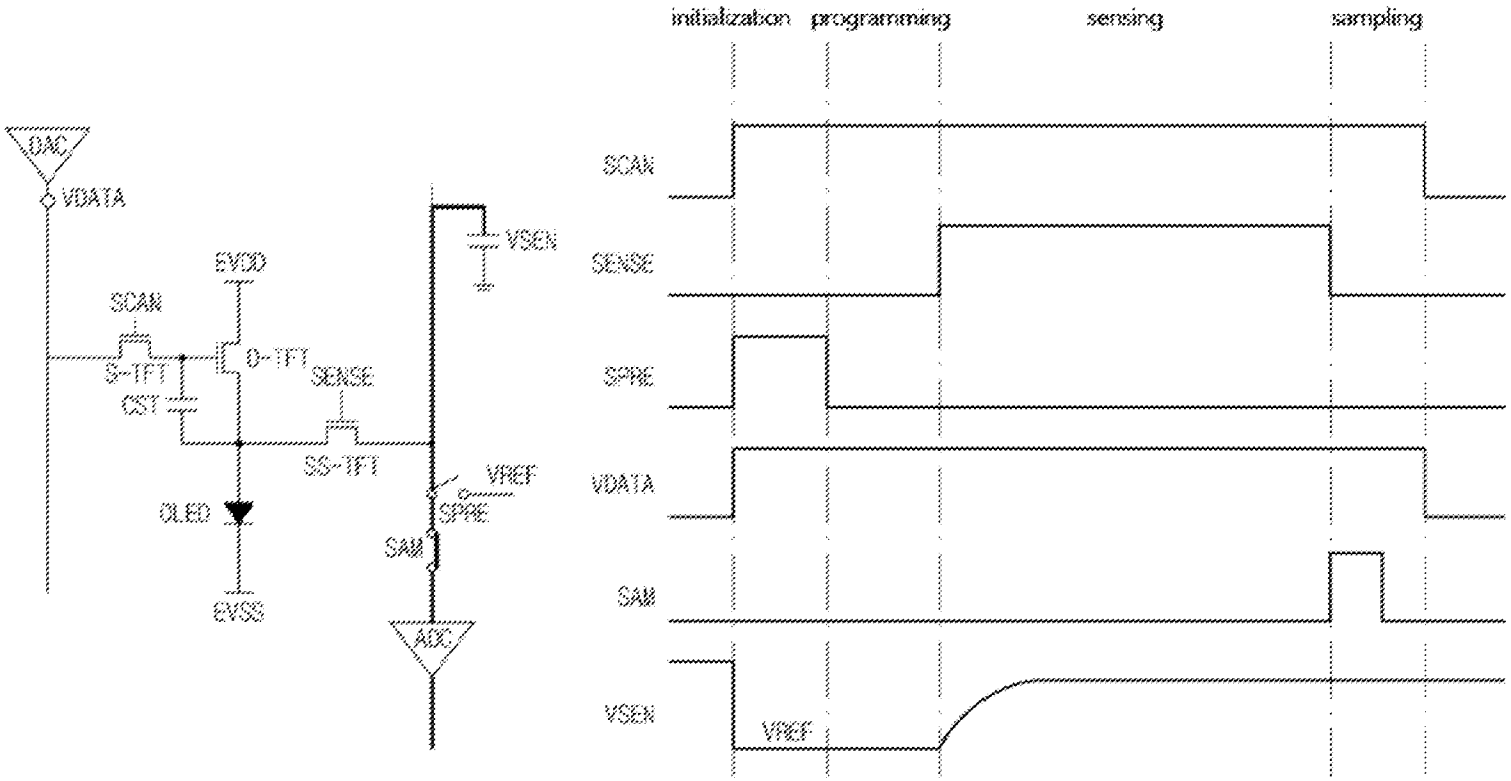

Referring to FIG. 6D, in the sampling period, the sensing TFT (SS-TFT) is turned off and the switch SAM is turned on. Accordingly, the sensing voltage VSEN is applied to the source driving IC (S-IC) via the ADC through the reference line REFERENCE. The source driving IC (S-IC) to which the sensing voltage VSEN is applied can calculate the threshold voltage characteristic of the corresponding driving TFT.

FIGS. 7A to 7E are views for describing sensing of degradation of an organic light emitting device (OLED). Each of the subpixels includes the light emitting device (OLED), and the degree of degradation is different for each light emitting device (OLED). Accordingly, the quality of the display image can be made uniform by sensing and compensating for the degradation of each light emitting device (OLED).

Figure 7A:
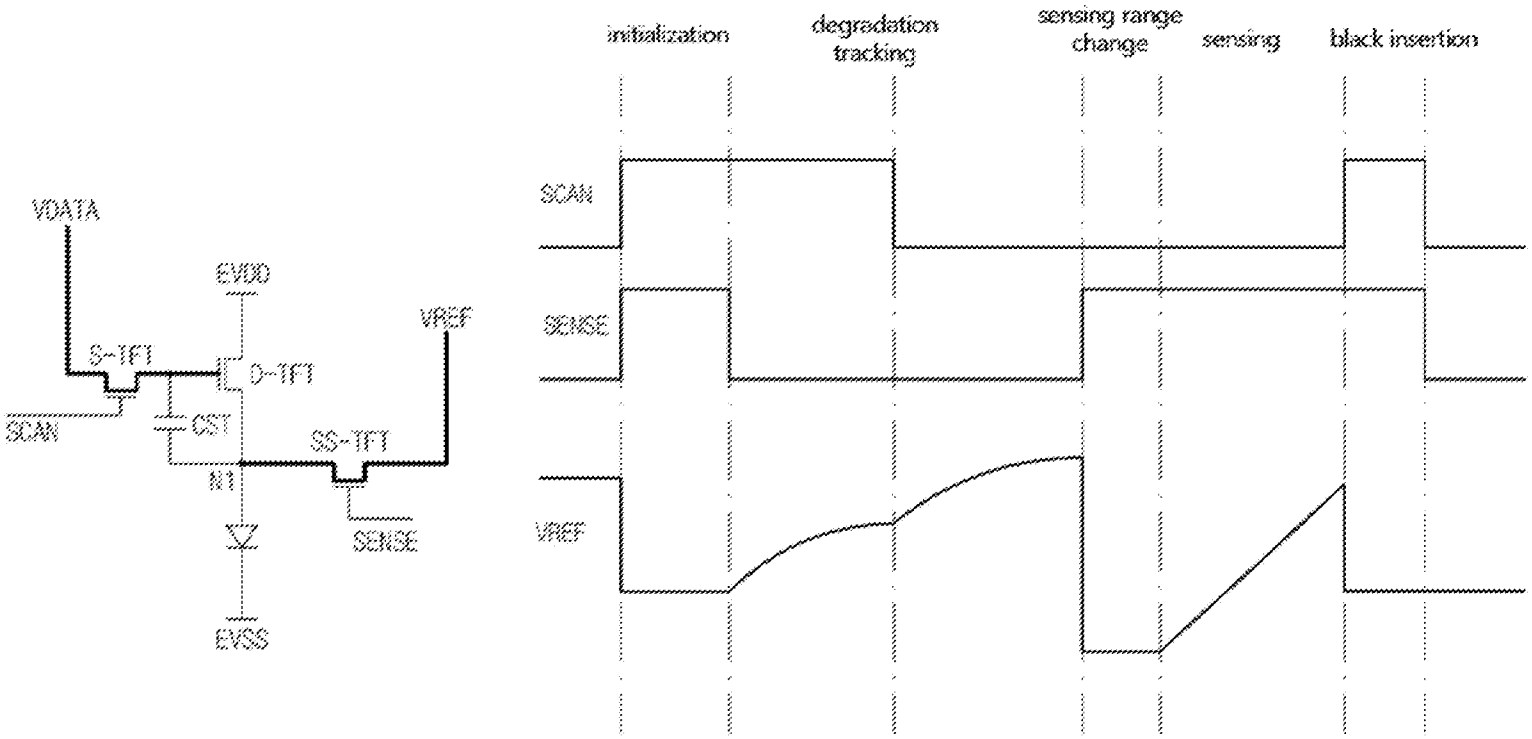
FIGS. 7A to 7E are views for describing sensing of degradation of an organic light emitting device (OLED)

Referring to FIG. 7A, in the initialization period, the scan TFT (S-TFT) is turned on and the sensing TFT (SS-TFT) is turned on. Accordingly, VDATA is charged in one end of the storage capacitor CST, and a node N1, that is the other end of the storage capacitor CST, is initialized.

Figure 7B:
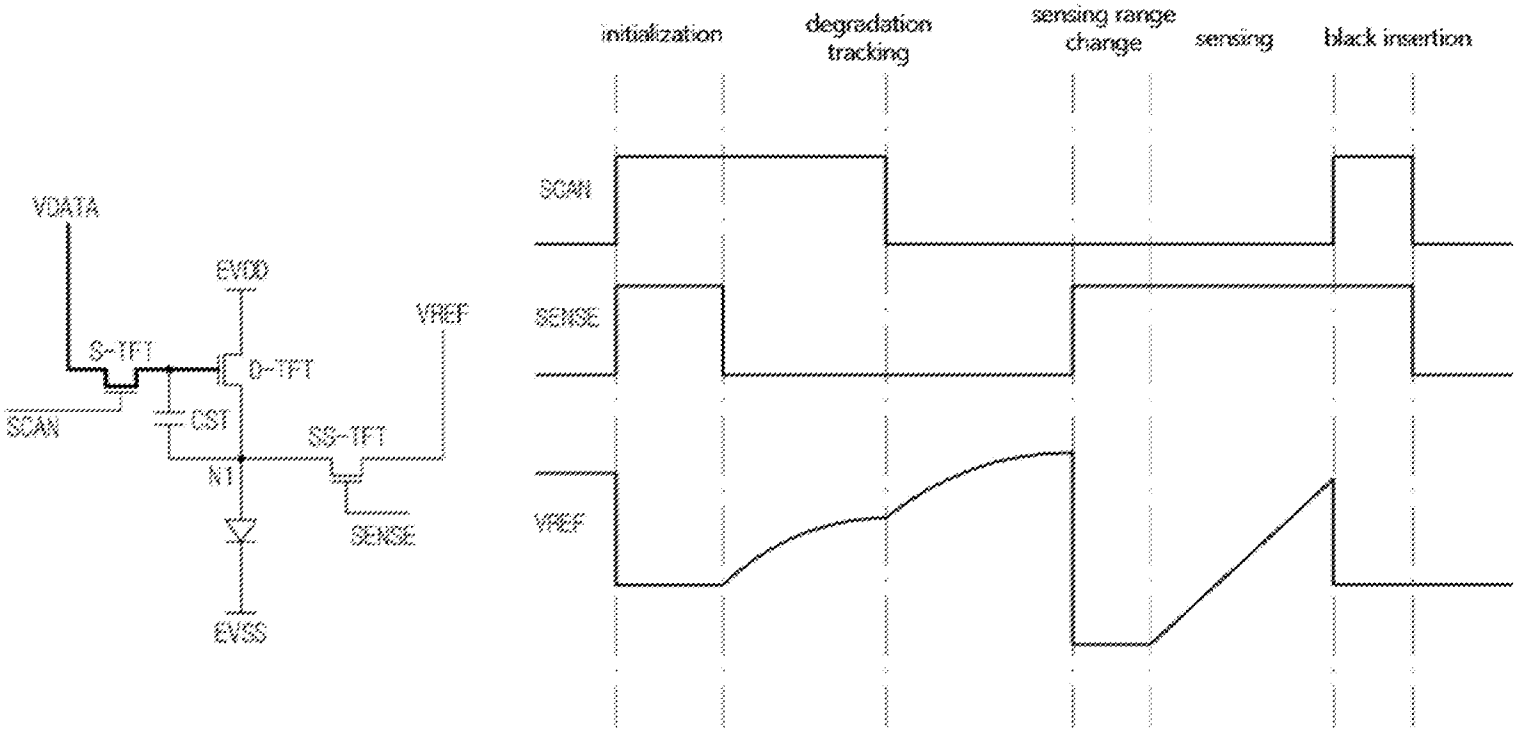

Referring to FIG. 7B, in a degradation tracking period, the scan TFT (S-TFT) is maintained to be turned on and the sensing TFT (SS-TFT) is turned off. While VDATA is maintained in one end of the storage capacitor CST, the other end (N1) is floating, so that the voltage of the node N1 increases. Then, the scan TFT (S-TFT) is turned off and thereby the other end of the storage capacitor CST is boosted. For example, the voltage of the node N1 increases once more. Here, a period in which the scan TFT (S-TFT) is turned on is referred to as a tracking front end period. The source end of the driving TFT is boosted in the tracking front end period. Meanwhile, a period in which the scan TFT is turned off is referred to as a tracking rear end period. The gate terminal and the source terminal of the driving TFT are boosted together in the tracking rear end period.

Figure 7C:
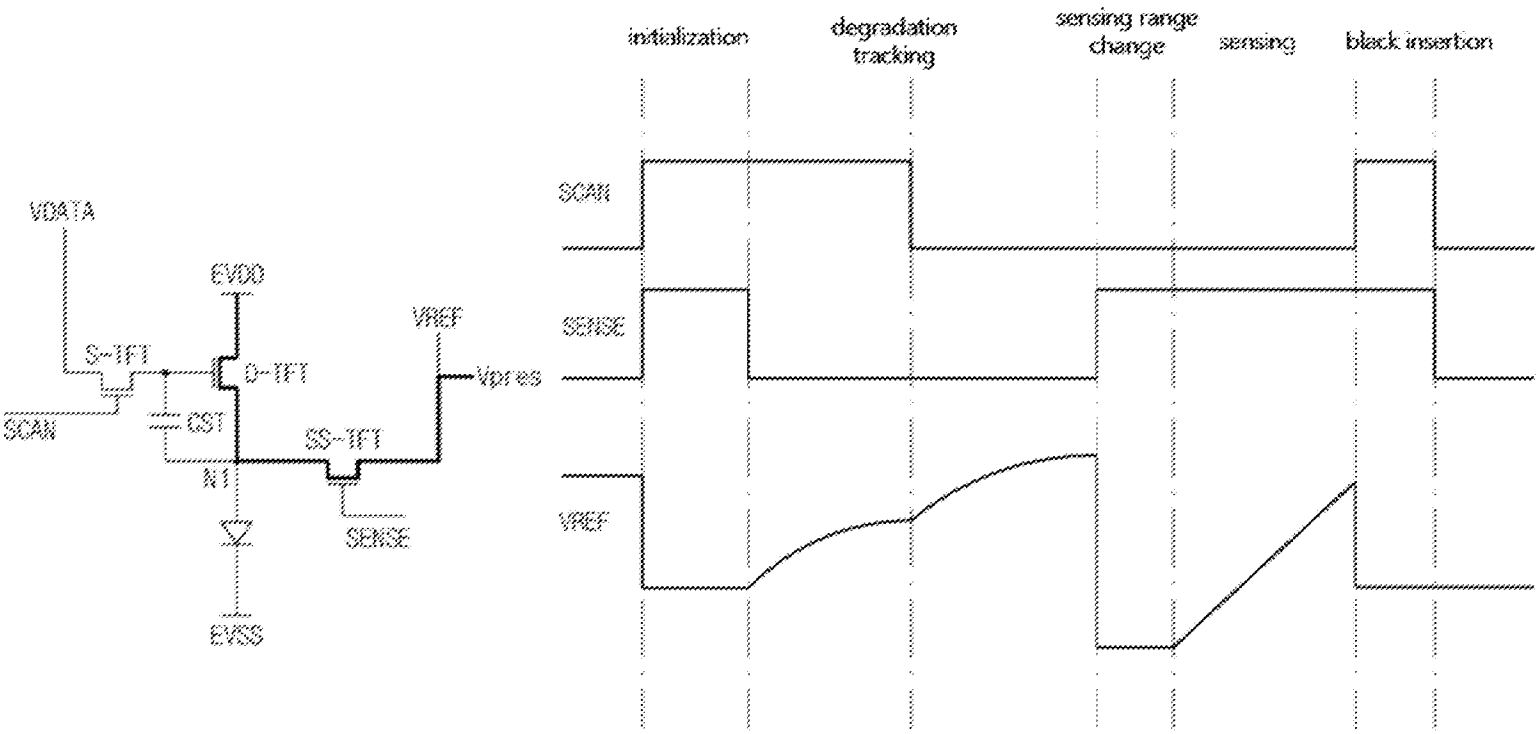

Referring to FIG. 7C, in a sensing range change period, the sensing TFT (SS-TFT) is turned on and is connected to a voltage Vpres. Accordingly, the voltage of the node N1 decreases to the Vpres. For example, in the sensing range change period, the voltage of the node N1 is decreased to a sensing range of the source driving IC (S-IC).

Figure 7D:
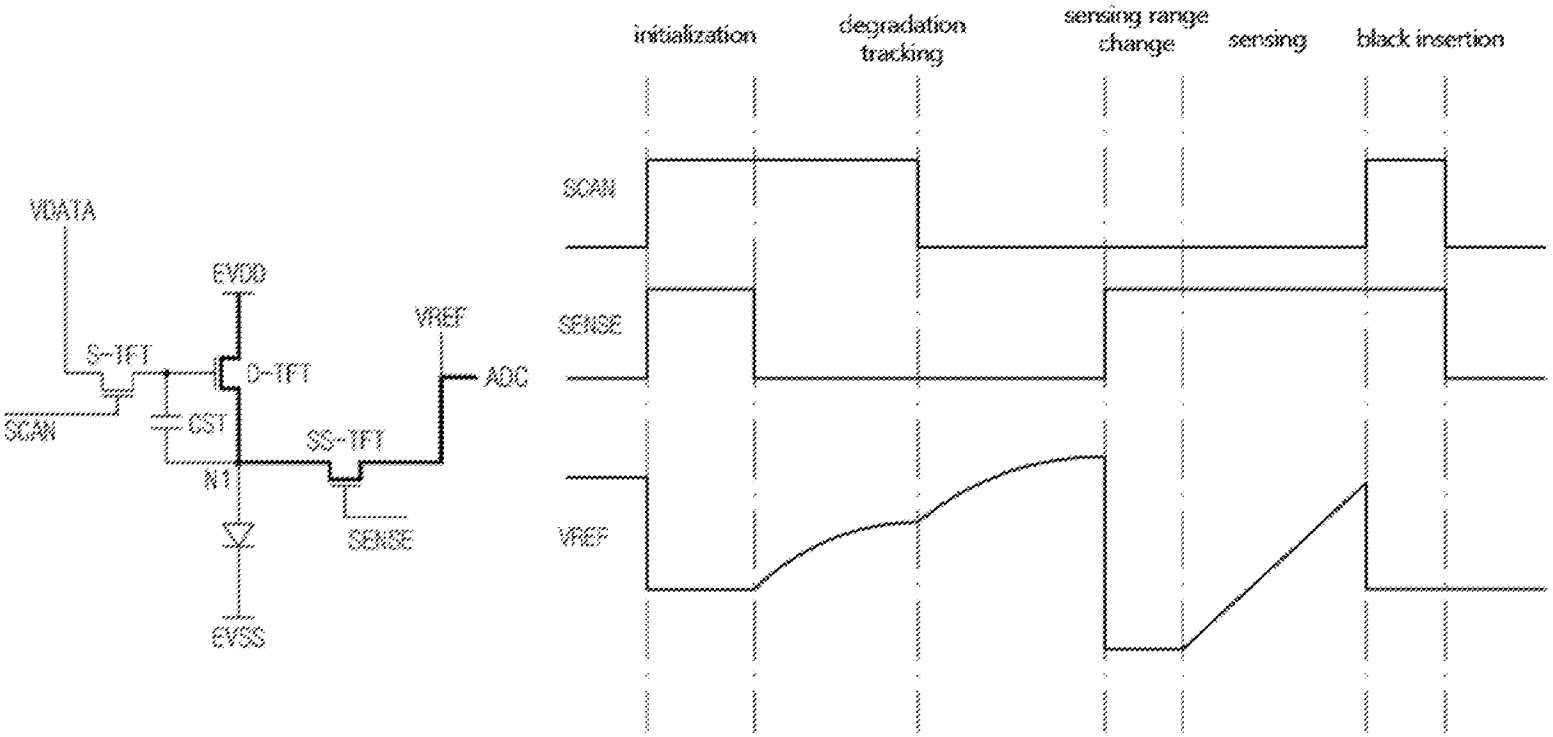

Referring to FIG. 7D, in the sensing period, the scan TFT (S-TFT) is turned off and the sensing TFT (SS-TFT) is turned on. Since the voltage across the storage capacitor CST is formed in the previous period, the driving TFT (D-TFT) operates like a constant current source with a constant magnitude, and the current passes through the sensing TFT (SS-TFT) and flows to the reference line. Here, the voltage of the node N1 increases with a constant voltage increase over time. Then, when a sampling switch connected to the reference line is turned on, the sensed voltage VREF is applied to the source driving IC (S-IC) through the ADC.

Figure 7E:
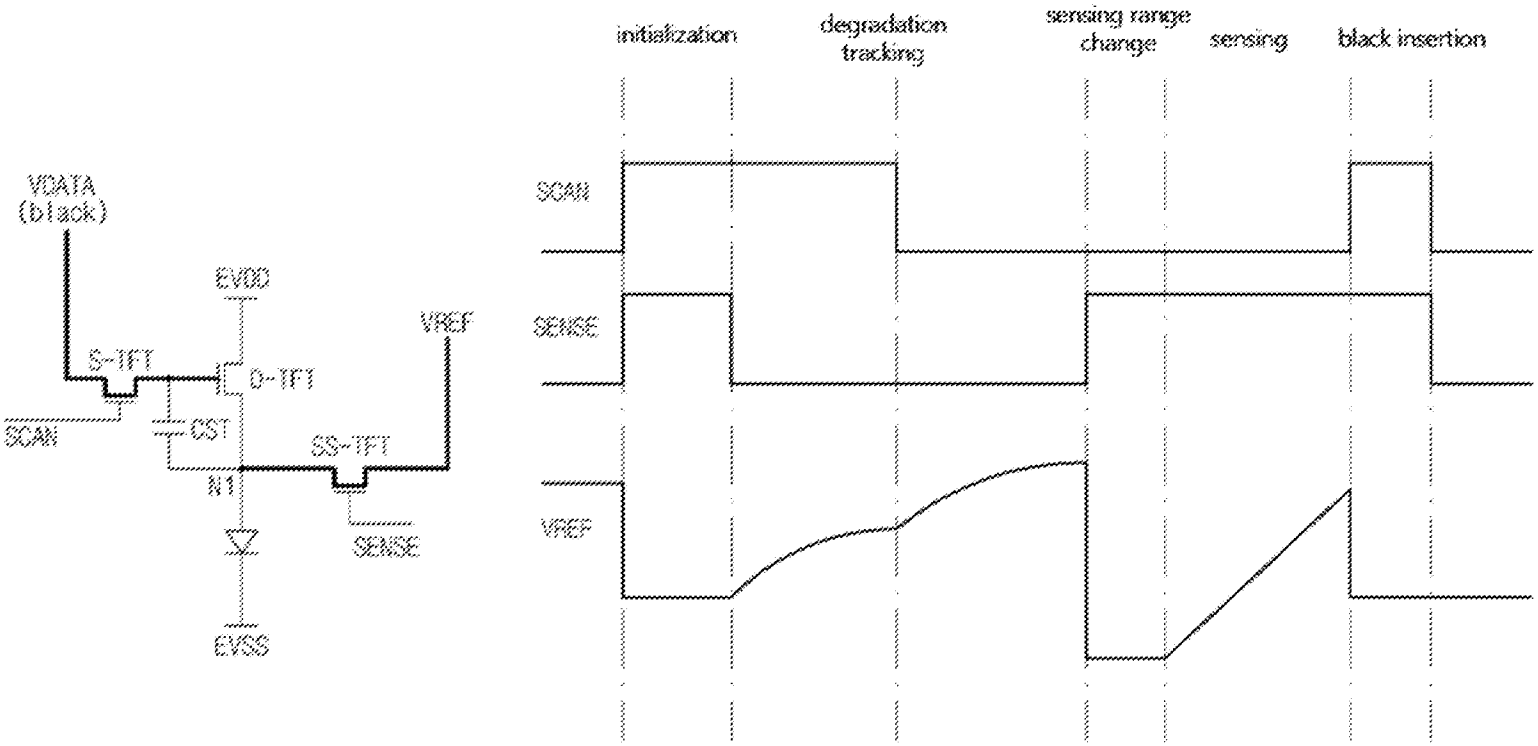
Figure 8A:
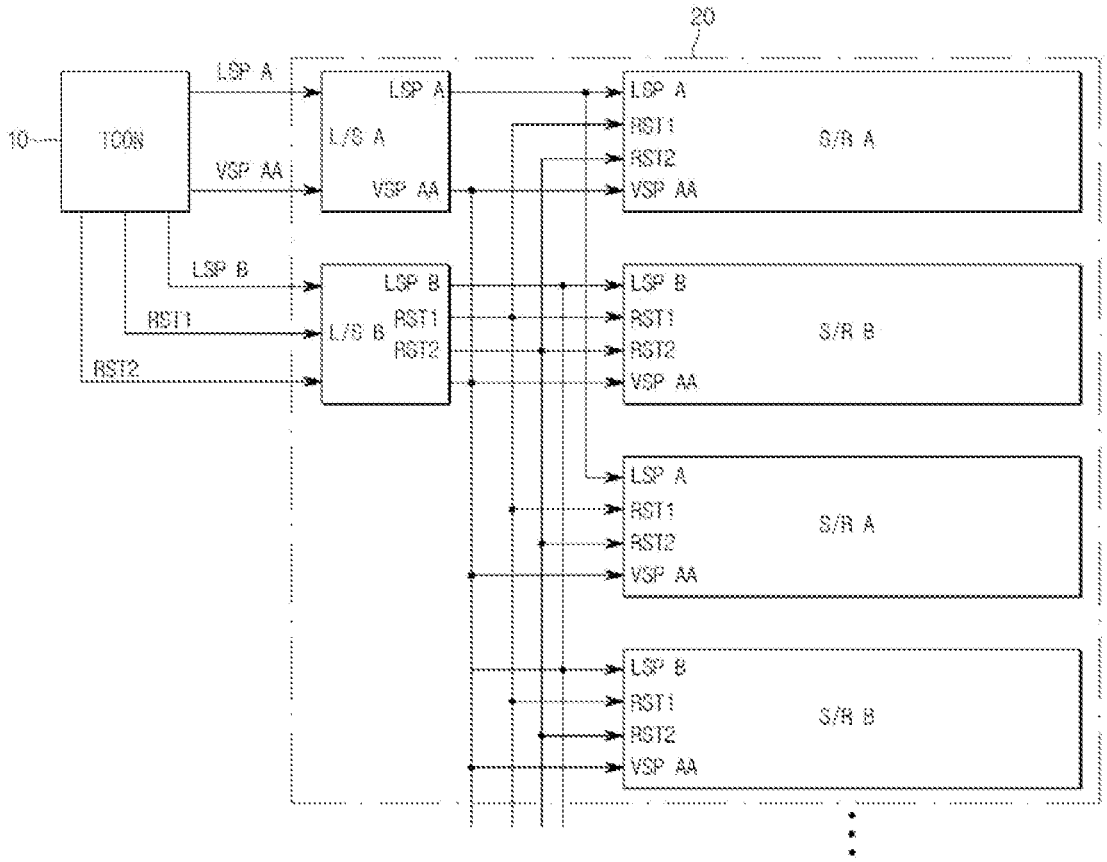
FIGS. 8A and 8B are views showing a gate driver 20 according to the embodiment of the present invention.
Figure 8B:
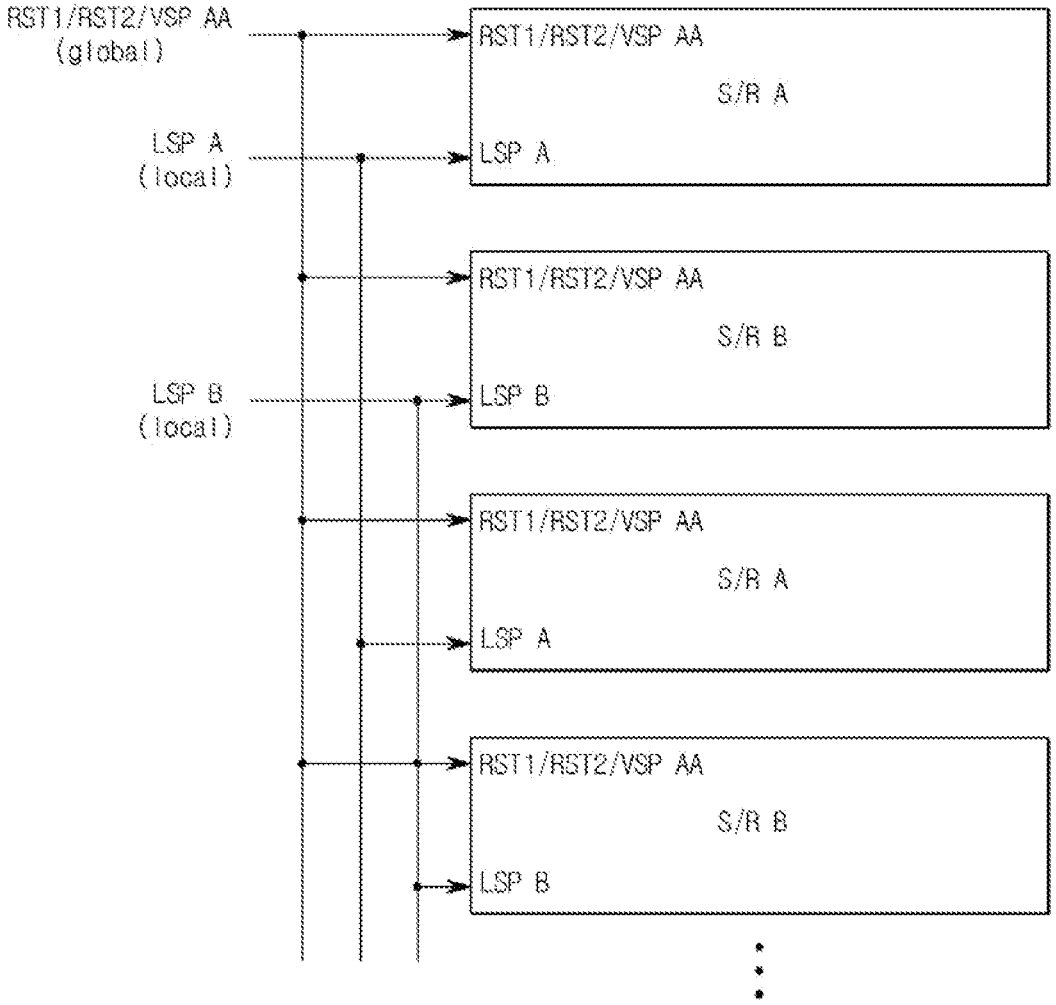

Referring to FIG. 7E, in a black insertion period, the scan TFT (S-TFT) is turned on and the sensing TFT (SS-TFT) is turned on. In this case, the voltage VDATA applied to the data line is a voltage indicating black. FIGS. 8A and 8B are views showing the gate driver 20 according to the embodiment of the present invention.

Referring to FIG. 8A, the gate driver 20 according to the embodiment includes a level shifter A (L/S A), a level shifter B (L/S B), a plurality of shift registers (S/R A) associated with the level shifter A (L/S A), and a plurality of shift registers (S/R B) associated with the level shifter B (L/S B).

An LSP A signal charges a node M within the shift register A. For example, when the shift register A receives the LSP A signal, the node M is charged. Such an LSP A signal can be applied to the shift register A while the black screen is displayed on the display panel.

An LSP B signal charges a node M within the shift register B. For example, when the shift register B receives the LSP B signal, the node M is charged. Such an LSP B signal can be applied to the shift register B while the black screen is displayed on the display panel.

An RST1 signal moves a carry charged in the node M within the shift register A or the shift register B to a node Q. For example, when the shift register A receives the RST1 signal, the shift register A moves the carry charged in the node M to the node Q. Also, when the shift register B receives the RST1 signal, the shift register B moves the carry charged in the node M to the node Q. Such an RST1 signal can be applied to the shift register A or the shift register B before the sensing of the subpixel is started.

An RST2 signal discharges the carry charged in the node Q within the shift register A or the shift register B. For example, when the shift register A receives the RST2 signal, the carry charged in the node Q is discharged. Also, when the shift register B receives the RST2 signal, the carry charged in the node Q is discharged. Such an RST2 signal can be applied to the shift register A or the shift register B after the sensing of the subpixel is finished.

A VSP AA signal discharges forcibly the carry charged in the node Q within the shift register A and the shift register B.

Referring to FIG. 8B, the RST1, RST2 and VSP AA signals are simultaneously applied to the shift register A and the shift register B. For example, the RST1, RST2 and VSP AA signals are connected to the shift registers A/B in a global way.

Meanwhile, the LSP A signal is simultaneously applied to the shift registers A and is not applied to the shift registers B. For example, the LSP A signal is connected to the shift register A in a local way.

Also, the LSP B signal is simultaneously applied to the shift registers B and is not applied to the shift registers A. For example, the LSP B signal is connected to the shift register B in a local way.

Figure 9A:
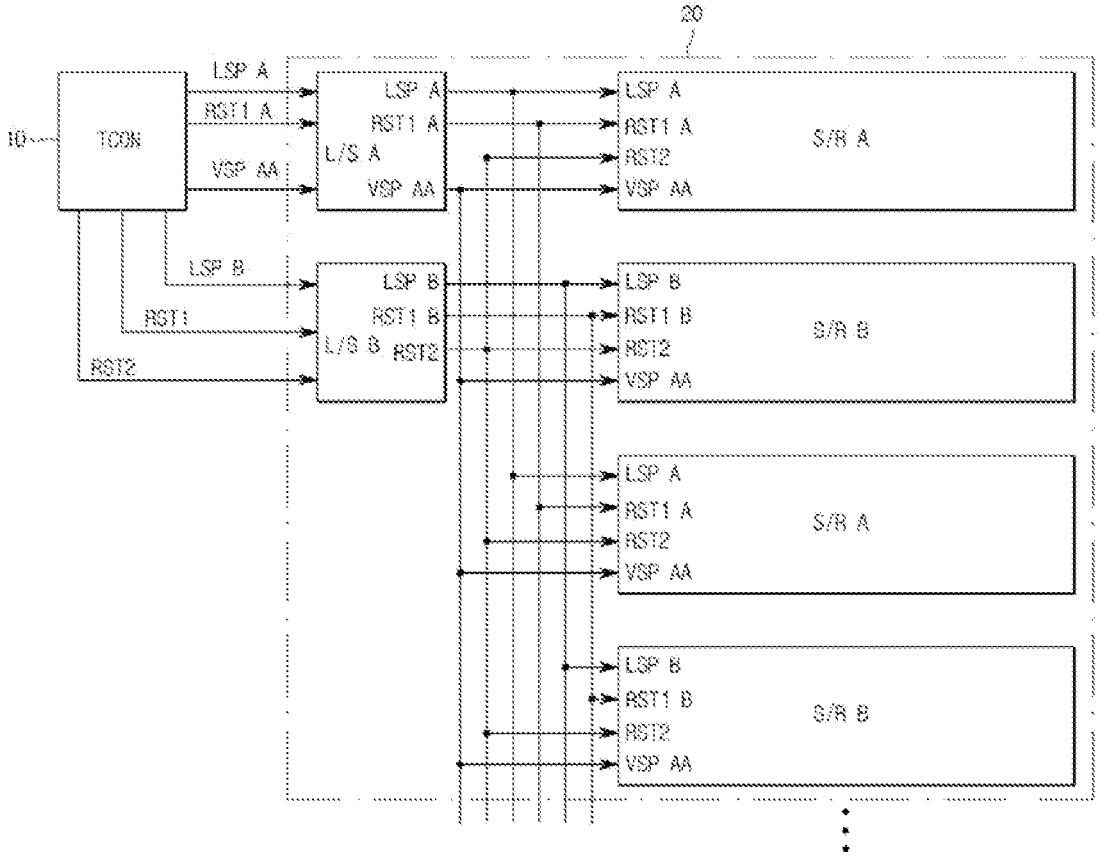
FIGS. 9A and 9B are views showing the gate driver 20 according to another embodiment of the present invention.
Figure 9B:
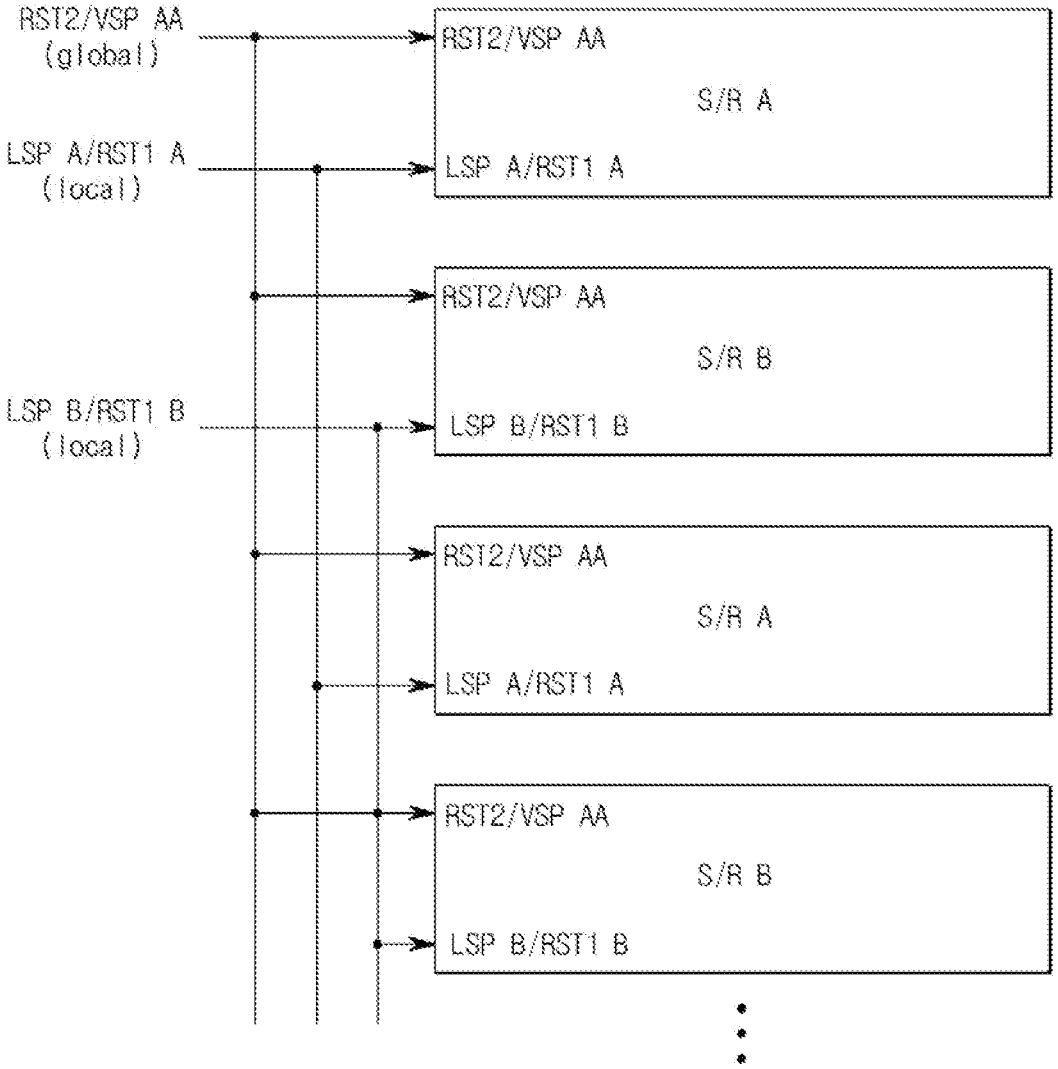

FIGS. 9A and 9B are views showing the gate driver 20 according to another embodiment of the present invention.

Referring to FIG. 9A, the gate driver 20 according to the embodiment includes a level shifter A (L/S A), a level shifter B (L/S B), a plurality of shift registers (S/R A) associated with the level shifter A (L/S A), and a plurality of shift registers (S/R B) associated with the level shifter B (L/S B).

An LSP A signal charges a node M within the shift register A. For example, when the shift register A receives the LSP A signal, the node M is charged. Such an LSP A signal can be applied to the shift register A while the black screen is displayed on the display panel.

An LSP B signal charges a node M within the shift register B. For example, when the shift register B receives the LSP B signal, the node M is charged. Such an LSP B signal can be applied to the shift register B while the black screen is displayed on the display panel.

An RST1 signal moves a carry charged in the node M within the shift register A or the shift register B to a node Q. For example, when the shift register A receives the RST1 signal, the shift register A moves the carry charged in the node M to the node Q. Also, when the shift register B receives the RST1 signal, the shift register B moves the carry charged in the node M to the node Q. Such an RST1 signal can be applied to the shift register A or the shift register B before the sensing of the subpixel is started.

An RST2 signal discharges the carry charged in the node Q within the shift register A or the shift register B. For example, when the shift register A receives the RST2 signal, the carry charged in the node Q is discharged. Also, when the shift register B receives the RST2 signal, the carry charged in the node Q is discharged. Such an RST2 signal can be applied to the shift register A or the shift register B after the sensing of the subpixel is finished.

A VSP AA signal discharges forcibly the carry charged in the node Q within the shift register A and the shift register B.

Referring to FIG. 9B, the RST2 and VSP AA signals are simultaneously applied to the shift register A and the shift register B. For example, the RST2 and VSP AA signals are connected to the shift registers A/B in a global way.

Meanwhile, an RST1 A signal and the LSP A signal are simultaneously applied to the shift registers A and are not applied to the shift registers B. For example, the RST1 A signal and the LSP A signal are connected to the shift register A in a local way.

Also, an RST1 B signal and the LSP B signal are simultaneously applied to the shift registers B and are not applied to the shift registers A. For example, the RST1 B signal and the LSP B signal are connected to the shift register B in a local way.

Figure 10:
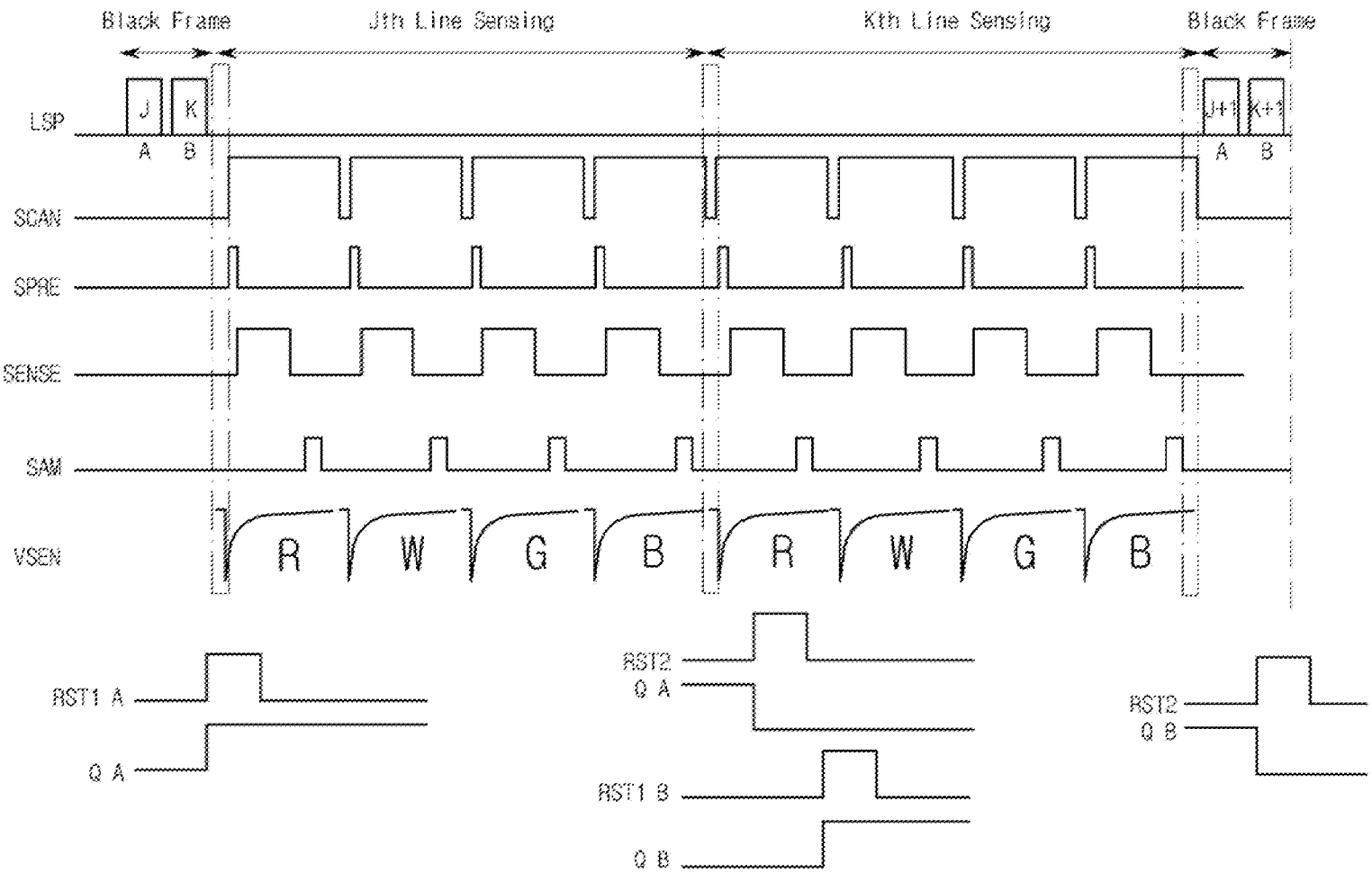
FIG. 10 is a timing diagram for describing sensing for compensation according to the embodiment of the present invention.

FIG. 10 is a timing diagram for describing sensing for compensation according to the embodiment of the present invention.

The compensation according to one or more embodiments of the present invention is for compensating for the threshold voltage characteristic of the driving TFT after the display device is powered off. For example, in a state where the display device is not turned off actually and a black screen is displayed although the user has powered off the display device, the sensing for such compensation can be performed. As described above, since the four subpixels share one reference line, it is preferable that the sensing of the four subpixels is not simultaneously performed. For example, it is preferable that subpixels having one color among the subpixels connected to a certain gate line are sensed and subsequently subpixels having other colors are sensed and all the subpixels of the corresponding gate line are sensed and then the next gate line is sensed. This is because, unlike real-time sensing, this case is free from time constraints.

Referring to FIG. 10, the LSP A and LSP B signals are applied while a 1 black frame is displayed. For example, the LSP A signal is applied to the shift register A and the LSP B signal is applied to the shift register B. Here, the shift register A is connected to a $J^{th}$ gate line of the display panel, and the shift register B is connected to a $K^{th}$ gate line of the display panel. As described above, when the shift register A receives the LSP A signal, the node M within the shift register A is charged, and when the shift register B receives the LSP B signal, the node M within the shift register B is charged.

The charging of the node M of the shift register A and the charging of the node M of the shift register B can be performed simultaneously or sequentially. As described with reference to FIGS. 9A and 9B, this is because the LSP A signal and the LSP B signal are input to the level shifters A/B through separate lines from the timing controller (TCON). Also, the LSP A signal is applied to the shift register A through a line connected in a local way, and the LSP B signal is applied to the shift register B through a line connected in a local way.

Then, the subpixels connected to the $J^{th}$ line are sensed, and the subpixels connected to the $K^{th}$ line are then sensed. For example, between the 1 black frame and the 1 black frame, in other words, when the black frame is displayed once, sensing of two gate lines ($J^{th}$ gate line and $K^{th}$ gate line) is performed. This can reduce a sensing time (tact time) by 50% compared to that of sensing of one gate line when the black frame is displayed in the past. A timing at which the subpixels are sensed is the same as that described with reference to FIGS. 6A to 6D.

Meanwhile, as an operation before the subpixels connected to the $J^{th}$ gate line are sensed, the shift register A receives the RST1 A signal. As described with reference to FIGS. 9A and 9B, the RST1 A signal is connected to the shift register A in a local way. When the shift register A receives the RST1 A signal, the carry charged in the node M within the shift register A is moved to the node Q, and accordingly, the node Q of the shift register A is charged.

Also, as an operation after the subpixels connected to the $J^{th}$ gate line are sensed, the shift register A receives the RST2 signal. As described with reference to FIGS. 9A and 9B, the RST2 signal is connected to the shift register A in a global way. When the shift register A receives the RST2 signal, the carry charged in the node Q within the shift register A is discharged.

As an operation before the subpixels connected to the $K^{th}$ gate line are sensed, the shift register B receives the RST1 B signal. As described with reference to FIGS. 9A and 9B, the RST1 B signal is connected to the shift register B in a local way. When the shift register B receives the RST1 B signal, the carry charged in the node M within the shift register B is moved to the node Q, and accordingly, the node Q of the shift register B is charged.

Also, as an operation after the subpixels connected to the $K^{th}$ gate line are sensed, the shift register B receives the RST2 signal. As described with reference to FIGS. 9A and 9B, the RST2 signal is connected to the shift register B in a global way. When the shift register B receives the RST2 signal, the carry charged in the node Q within the shift register B is discharged.

As such, when the sensing of the subpixels connected to the $J^{th}$ gate line and the sensing of the subpixels connected to the $K^{th}$ gate line are terminated, a black frame is displayed on the display panel, and sensing of the $J+1^{th}$ line and $K+1^{th}$ line will be initiated.

Figure 11:
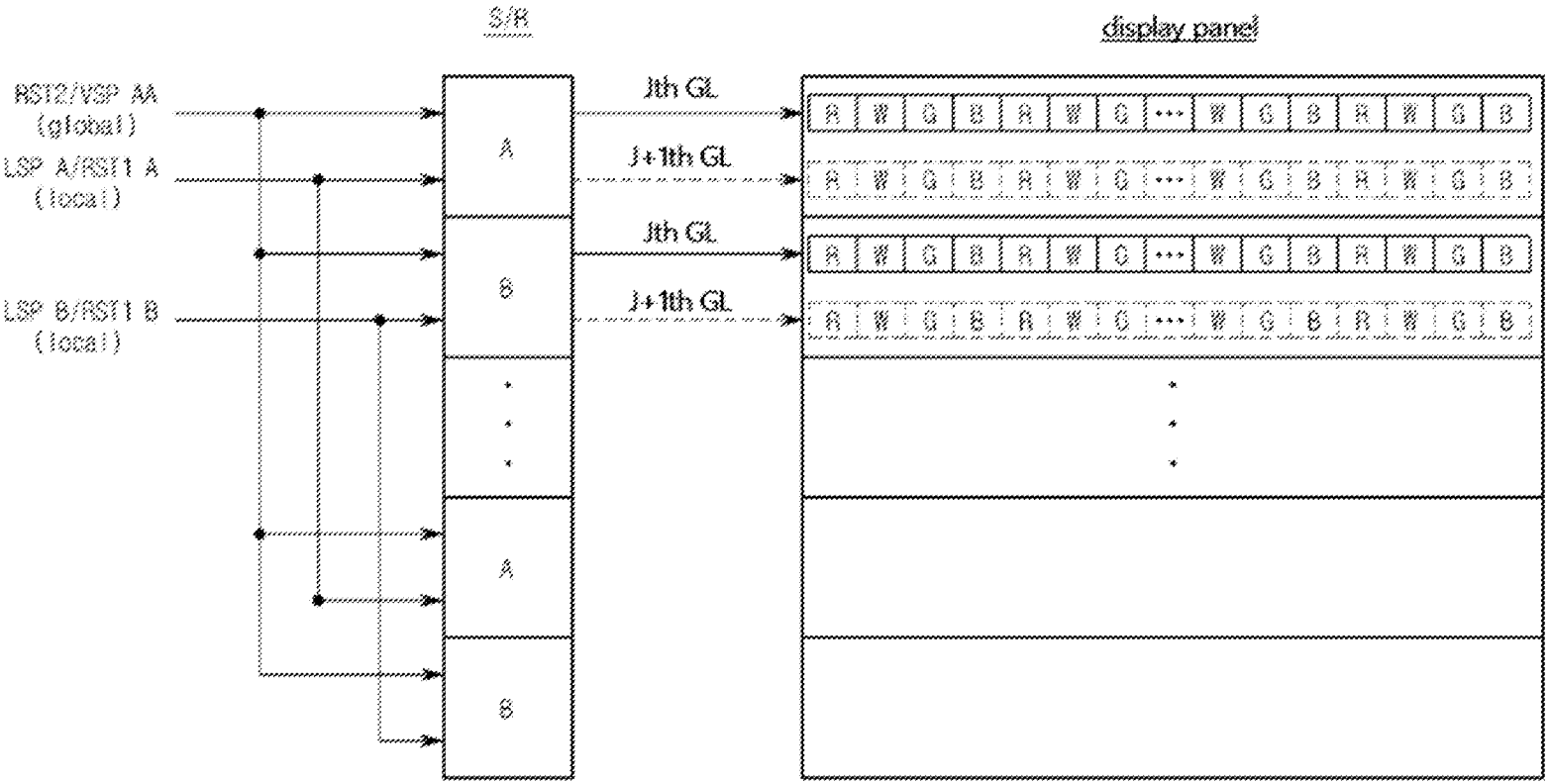
FIG. 11 is a view for describing the display device which performs the sensing for compensation according to the embodiment of the present invention.

FIG. 11 is a view for describing the display device which performs the sensing for the compensation according to the embodiment of the present invention.

The compensation according to one or more embodiments of the present invention is for compensating for the threshold voltage characteristic of the driving TFT after the display device is powered off. For example, in a state where the display device is not turned off actually and a black screen is displayed although the user has powered off the display device, the sensing for such compensation can be performed. As described above, since the four subpixels share one reference line, it is preferable that the sensing of the four subpixels is not simultaneously performed. For example, it is preferable that subpixels having one color among the subpixels connected to a certain gate line are sensed and subsequently subpixels having other colors are sensed and all the subpixels of the corresponding gate line are sensed and then the next gate line is sensed. This is because, unlike real-time sensing, this case is free from time constraints.

Referring to FIG. 11, the display panel includes a plurality of subpixels. As described with reference to FIG. 1, the gate driver 20 is connected to the subpixels through the gate lines. Also, the data driver 30 is connected to the subpixels through the data lines. The gate driver includes the shift register, and as shown in FIG. 11, the gate driver includes the shift register A and the shift register B.

The LSP A signal charges the node M within the shift register A. For example, when the shift register A receives the LSP A signal, the node M is charged. Such an LSP A signal can be applied to the shift register A while the black screen is displayed on the display panel.

The LSP B signal charges the node M within the shift register B. For example, when the shift register B receives the LSP B signal, the node M is charged. Such an LSP B signal can be applied to the shift register B while the black screen is displayed on the display panel.

The RST1 signal moves a carry charged in the node M within the shift register A or the shift register B to the node Q. For example, when the shift register A receives the RST1 signal, the shift register A moves the carry charged in the node M to the node Q. Also, when the shift register B receives the RST1 signal, the shift register B moves the carry charged in the node M to the node Q. Such an RST1 signal can be applied to the shift register A or the shift register B before the sensing of the subpixel is started.

The RST2 signal discharges the carry charged in the node Q within the shift register A or the shift register B. For example, when the shift register A receives the RST2 signal, the carry charged in the node Q is discharged. Also, when the shift register B receives the RST2 signal, the carry charged in the node Q is discharged. Such an RST2 signal can be applied to the shift register A or the shift register B after the sensing of the subpixel is finished.

The VSP AA signal discharges forcibly the carry charged in the node Q within the shift register A and the shift register B.

Referring to FIG. 11, the RST2 and VSP AA signals are simultaneously applied to the shift register A and the shift register B. For example, the RST2 and VSP AA signals are connected to the shift registers A/B in a global way.

Meanwhile, the RST1 A signal and the LSP A signal are simultaneously applied to the shift registers A and are not applied to the shift registers B. For example, the RST1 A signal and the LSP A signal are connected to the shift register A in a local way.

Further, the RST1 B signal and the LSP B signal are simultaneously applied to the shift registers B and are not applied to the shift registers A. For example, the RST1 B signal and the LSP B signal are connected to the shift register B in a local way.

In this embodiment, the shift register A is connected to the $J^{th}$ gate line of the display panel, and the shift register B is connected to the $K^{th}$ gate line of the display panel.

According to this embodiment, while the 1 black frame is displayed, the shift register A receives the LSP A signal, and the shift register B receives the LSP B signal. When the shift register A receives the LSP A signal, the node M within the shift register A is charged. When the shift register B receives the LSP B signal, the node M within the shift register B is charged. The charging of the node M of the shift register A and the charging of the node M of the shift register B can be performed simultaneously or sequentially. As described with reference to FIGS. 9A and 9B, this is because the LSP A signal and the LSP B signal are input to the level shifters A/B through separate lines from the timing controller (TCON). Also, the LSP A signal is applied to the shift register A through a line connected in a local way, and the LSP B signal is applied to the shift register B through a line connected in a local way.

Then, the subpixels connected to the $J^{th}$ line are sensed, and the subpixels connected to the $K^{th}$ line are then sensed. For example, between the 1 black frame and the 1 black frame, in other words, when the black frame is displayed once, sensing of two gate lines ($J^{th}$ gate line and $K^{th}$ gate line) is performed. This can reduce a sensing time (tact time) by 50% compared to that of sensing of one gate line when the black frame is displayed in the past. A timing at which the subpixels are sensed is the same as that described with reference to FIGS. 6A to 6D.

Meanwhile, as an operation before the subpixels connected to the $J^{th}$ gate line are sensed, the shift register A receives the RST1 A signal. As described with reference to FIGS. 9A and 9B, the RST1 A signal is connected to the shift register A in a local way. When the shift register A receives the RST1 A signal, the carry charged in the node M within the shift register A is moved to the node Q, and accordingly, the node Q of the shift register A is charged.

Also, as an operation after the subpixels connected to the $J^{th}$ gate line are sensed, the shift register A receives the RST2 signal. As described with reference to FIGS. 9A and 9B, the RST2 signal is connected to the shift register A in a global way. When the shift register A receives the RST2 signal, the carry charged in the node Q within the shift register A is discharged.

As an operation before the subpixels connected to the $K^{th}$ gate line are sensed, the shift register B receives the RST1 B signal. As described with reference to FIGS. 9A and 9B, the RST1 B signal is connected to the shift register B in a local way. When the shift register B receives the RST1 B signal, the carry charged in the node M within the shift register B is moved to the node Q, and accordingly, the node Q of the shift register B is charged.

As an operation after the subpixels connected to the $K^{th}$ gate line are sensed, the shift register B receives the RST2 signal. As described with reference to FIGS. 9A and 9B, the RST2 signal is connected to the shift register B in a global way. When the shift register B receives the RST2 signal, the carry charged in the node Q within the shift register B is discharged.

As such, when the sensing of the subpixels connected to the $J^{th}$ gate line and the sensing of the subpixels connected to the $K^{th}$ gate line are terminated, a black frame is displayed on the display panel, and sensing of the $J+1^{th}$ line and $K+1^{th}$ line will be initiated.

It can be understood by those skilled in the art that the embodiments can be embodied in other specific forms without departing from its spirit or essential characteristics. Therefore, the foregoing embodiments and advantages are merely exemplary and are not to be construed as limiting the present invention. It can be understood by those skilled in the art that the embodiments can be embodied in other specific forms without departing from its spirit or essential characteristics. Therefore, the foregoing embodiments and advantages are merely exemplary and are not to be construed as limiting the present invention. The scopes of the embodiments are described by the scopes of the following claims rather than by the foregoing description. All modification, alternatives, and variations derived from the scope and the meaning of the scope of the claims and equivalents of the claims should be construed as being included in the scopes of the embodiments.

What is claimed is:

1. A sensing method for compensation, which is performed after a display device including a display panel is powered off, the sensing method comprising:

displaying one black frame;

charging a node M of a first shift register connected to a $j^{th}$ gate line of the display panel;

charging a node M of a second shift register connected to a $K^{th}$ gate line of the display panel; and sensing subpixels connected to the $j^{th}$ gate line and then sensing subpixels connected to the $K^{th}$ gate line, wherein the charging the node M of the first shift register and the charging the node M of the second shift register are performed during the displaying of the one black frame.

2. The sensing method of claim 1, wherein the charging the node M of the first shift register and the charging the node M of the second shift register are performed sequentially.

3. A sensing method for compensation, which is performed after a display device including a display panel is powered off, the sensing method comprising:

displaying one black frame;

charging a node M of a first shift register connected to a jth gate line of the display panel;

charging a node M of a second shift register connected to a Kth gate line of the display panel; and sensing subpixels connected to the jth gate line and then sensing subpixels connected to the Kth gate line, wherein the charging the node M of the first shift register comprises receiving an LSP A signal through a line to which the first shift register is connected in a local way.

4. A sensing method for compensation, which is performed after a display device including a display panel is powered off, the sensing method comprising:

displaying one black frame;

charging a node M of a first shift register connected to a jth gate line of the display panel;

charging a node M of a second shift register connected to a Kth gate line of the display panel; and sensing subpixels connected to the jth gate line and then sensing subpixels connected to the Kth gate line, wherein the charging the node M of the second shift register comprises receiving an LSP B signal through a line to which the second shift register is connected in a local way.

5. A sensing method for compensation, which is performed after a display device including a display panel is powered off, the sensing method comprising:

displaying one black frame;

charging a node M of a first shift register connected to a jth gate line of the display panel;

charging a node M of a second shift register connected to a Kth gate line of the display panel; and sensing subpixels connected to the jth gate line and then sensing subpixels connected to the Kth gate line, wherein the method further comprises: before sensing the subpixels connected to the $j^{th}$ gate line, receiving an RST1 A signal through a line to which the first shift register is connected in a local way; and charging a node Q of the first shift register as a carry charged in the node M of the first shift register moves to the node Q.

6. The sensing method of claim 5, further comprising: after sensing the subpixels connected to the $j^{th}$ gate line, receiving an RST2 signal through a line to which the first shift register is connected in a global way; and discharging the node Q of the first shift register.

7. The sensing method of claim 6, further comprising: before sensing the subpixels connected to the $K^{th}$ gate line, receiving an RST1 B signal through a line to which the second shift register is connected in a local way; and charging a node Q of the second shift register as a carry charged in the node M of the second shift register moves to the node Q.

8. The sensing method of claim 7, further comprising: after sensing the subpixels connected to the $K^{th}$ gate line, receiving the RST2 signal through a line to which the second shift register is connected in a global way; and discharging the node Q of the second shift register.

9. A display device which performs sensing for compensation, which is performed after the display device is powered off, the display device comprising:

a display panel including a plurality of subpixels;

a gate driver which is connected with the subpixels through gate lines including a $j^{th}$ gate line and a $K^{th}$ gate line; and a data driver which is connected to the subpixels through a data line, wherein the gate driver comprises:

a first shift register which receives an RST2 signal in a global way, receives an LSP A signal and an RST1 A signal in a local way, and is connected with the $j^{th}$ gate line; and a second shift register which receives the RST2 signal in a global way, receives an LSP B signal and an RST1 B signal in a local way, and is connected with the $K^{th}$ gate line, wherein after one black frame is displayed, the first shift register performs sensing for compensation for the subpixels connected with the jth gate line, and subsequently the second shift register performs sensing for compensation for the subpixels connected with the Kth gate line.

10. The display device of claim 9, wherein, while the one black frame is displayed, the first shift register connected to the $j^{th}$ gate line receives an LSP A signal, and the second shift register connected to the $K^{th}$ gate line receives an LSP B signal.

11. The display device of claim 10, wherein the receiving the LSP A signal by the first shift register and the receiving the LSP B signal by the second shift register are performed sequentially.

12. The display device of claim 9, wherein, before the first shift register performs sensing for compensation for the subpixels connected with the $j^{th}$ gate line, the first shift register receives the RST1 A signal, and a node Q of the first shift register is charged.

13. The display device of claim 12, wherein, after the first shift register performs sensing for compensation for the subpixels connected with the $j^{th}$ gate line, the first shift register receives the RST2 signal, and the node Q of the first shift register is discharged.

14. The display device of claim 13, wherein, before the second shift register performs sensing for compensation for the subpixels connected with the $K^{th}$ gate line, the second shift register receives the RST1 B signal, and a node Q of the second shift register is charged.

15. The display device of claim 14, wherein, after the second shift register performs sensing for compensation for the subpixels connected with the $K^{th}$ gate line, the second shift register receives the RST2 signal, and the node Q of the second shift register is discharged.

* * * * *